US008888582B2

(12) United States Patent
Louie et al.

(10) Patent No.: US 8,888,582 B2
(45) Date of Patent: Nov. 18, 2014

(54) WAGERING GAME HAVING SYMBOL TRANSFER FROM FEEDER ARRAY TO PRIMARY ARRAY

(71) Applicant: WMS Gaming Inc., Waukegan, IL (US)

(72) Inventors: Daniel P. Louie, Chicago, IL (US); Jamie W. Vann, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

(21) Appl. No.: 13/783,543

(22) Filed: Mar. 4, 2013

(65) Prior Publication Data

US 2013/0303260 A1 Nov. 14, 2013

Related U.S. Application Data

(60) Provisional application No. 61/644,407, filed on May 8, 2012.

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01)
USPC ..... 463/21

(58) Field of Classification Search
CPC ..... G07F 17/34; G07F 17/32; A63F 9/24; A63F 13/00
USPC ..... 463/21
See application file for complete search history.

(56) References Cited

U.S. PATENT DOCUMENTS

| | | | |
|---|---|---|---|
| 5,732,950 | A | 3/1998 | Moody |
| 5,823,873 | A | 10/1998 | Moody |
| 5,833,537 | A | 11/1998 | Barrie |
| 5,976,016 | A | 11/1999 | Moody et al. |
| 5,997,401 | A | 12/1999 | Crawford |
| 6,007,066 | A | 12/1999 | Moody |
| 6,056,642 | A | 5/2000 | Bennett |
| 6,089,977 | A | 7/2000 | Bennett |
| 6,098,985 | A | 8/2000 | Moody |
| 6,120,378 | A | 9/2000 | Moody et al. |
| 6,159,095 | A | 12/2000 | Frohm et al. |
| 6,203,428 | B1 | 3/2001 | Giobbi et al. |
| 6,251,013 | B1 | 6/2001 | Bennett |

(Continued)

FOREIGN PATENT DOCUMENTS

| | | | |
|---|---|---|---|
| EP | 0062433 | A2 | 10/1982 |
| EP | 0060018 | B1 | 12/1986 |

(Continued)

*Primary Examiner* — William M Brewster
*Assistant Examiner* — Jason Skaarup
(74) *Attorney, Agent, or Firm* — Nixon Peabody LLP

(57) ABSTRACT

A primary array of symbol positions arranged in a plurality of columns and a feeder array of symbol positions arranged in one or more columns are displayed. A plurality of symbols including a special symbol is randomly distributed such that (i) each of the symbol positions of the primary and feeder arrays is associated with one of the plurality of symbols thereby forming a first outcome. In response to one of the symbol positions of the primary array being associated with the special symbol, one or more of the symbols associated with the feeder array is visually transferred to the primary array of symbol positions. The first outcome is modified with the one or more transferred symbols thereby forming a second outcome.

33 Claims, 24 Drawing Sheets

(56) References Cited

U.S. PATENT DOCUMENTS

| | | | |
|---|---|---|---|
| 6,270,412 | B1 | 8/2001 | Crawford et al. |
| 6,315,291 | B1 | 11/2001 | Moody |
| 6,517,074 | B1 | 2/2003 | Moody et al. |
| 6,517,433 | B2 | 2/2003 | Loose et al. |
| 6,561,898 | B2 | 5/2003 | Moody |
| 6,568,680 | B1 | 5/2003 | Moody et al. |
| 6,652,377 | B1 | 11/2003 | Moody |
| 6,918,832 | B2 | 7/2005 | Baerlocher et al. |
| 6,955,356 | B2 | 10/2005 | Moody |
| 6,964,418 | B2 | 11/2005 | Moody |
| 6,981,635 | B1 | 1/2006 | Hughs-Baird et al. |
| 7,137,628 | B2 | 11/2006 | Moody |
| 7,222,857 | B2 | 5/2007 | Moody |
| 7,222,858 | B2 | 5/2007 | Moody |
| 7,396,279 | B2 | 7/2008 | Berman et al. |
| 7,404,762 | B2 | 7/2008 | Moody |
| 7,431,644 | B2 | 10/2008 | Moody |
| 7,526,736 | B2 | 4/2009 | Kaminkow et al. |
| 7,527,557 | B2 | 5/2009 | Jackson |
| 2003/0186737 | A1 | 10/2003 | Bennett et al. |
| 2004/0097280 | A1 | 5/2004 | Gauselmann |
| 2005/0049030 | A1 | 3/2005 | Tachikawa |
| 2005/0170882 | A1* | 8/2005 | Osawa ..... 463/20 |
| 2010/0069160 | A1 | 3/2010 | Barrett et al. |
| 2010/0120507 | A1* | 5/2010 | Rodgers et al. ..... 463/20 |
| 2010/0234099 | A1 | 9/2010 | Rasmussen et al. |
| 2011/0105218 | A1 | 5/2011 | Anderson et al. |
| 2011/0218034 | A1 | 9/2011 | Barclay et al. |

FOREIGN PATENT DOCUMENTS

| | | | | |
|---|---|---|---|---|
| GB | 2097160 A | * | 10/1982 | ..... G07F 17/34 |
| GB | 2119991 A | | 11/1983 | |
| GB | 2137392 A | | 10/1984 | |

* cited by examiner

WAGERING GAME HAVING SYMBOL TRANSFER FROM FEEDER ARRAY TO PRIMARY ARRAY

CROSS-REFERENCE TO RELATED APPLICATION

This application claims the benefit of U.S. Provisional Application No. 61/644,407, filed May 8, 2012, which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to wagering game machines and, more particularly, to wagering game machines having symbol transfers from a feeder array to a primary array.

BACKGROUND

Gaming machines or terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing terminals and the expectation of winning each terminal is roughly the same (or believed to be the same), players are most likely to be attracted to the more entertaining and exciting terminal. As a result, wagering game machine operators strive to employ the most entertaining and exciting machines available, because such machines attract frequent play and provide increased profitability for the operators.

SUMMARY OF THE INVENTION

A method for conducting a wagering game via a gaming terminal includes receiving, via an input device, a wager to play the wagering game. A primary array of symbol positions arranged in a plurality of columns and a feeder array of symbol positions arranged in one or more columns are displayed on one or more display devices. A plurality of symbols including a special symbol is randomly distributed, by at least one of one or more processors, such that (i) each of the symbol positions of the primary array is associated with one of the plurality of symbols thereby forming a first outcome, and (ii) each of the symbol positions of the feeder array is associated with one of the plurality of symbols. In response to one of the symbol positions of the primary array being associated with the special symbol, a first one of the symbols associated with the feeder array is visually transferred, by at least one of the one or more processors, to the primary array of symbol positions. The first one of the symbols is thereby a first transferred symbol. The first outcome is modified, by at least one of the one or more processors, with the first transferred symbol thereby forming a second outcome.

A method for conducting a wagering game via a gaming terminal includes receiving, via an input device, a wager to play the wagering game. A primary array of symbol positions arranged in a plurality of columns and a feeder array of symbol positions arranged in one or more columns are displayed on one or more display devices. A plurality of symbols including a special symbol is randomly distributed by at least one of one or more processors such that: (i) each of the symbol positions of the primary array is associated with one of the plurality of symbols thereby forming a first outcome, and (ii) each of the symbol positions of the feeder array is associated with one of the plurality of symbols. In response to one of the symbol positions of the primary array being associated with the special symbol, one of the plurality of symbols to be visually transferred is randomly selected by at least one of the one or more processors. The randomly selected symbol from each of the symbol positions of the feeder array associated with the randomly selected symbol, which are transferred-selected symbols, are visually transferred by at least one of the one or more processors to the primary array of symbol positions. The first outcome is modified by at least one of the one or more processors with the transferred-selected symbols to form a second outcome.

A method for conducting a wagering game via a gaming terminal includes receiving, via an input device, a wager to play the wagering game. A primary array of symbol positions arranged in a plurality of columns is displayed on one or more display devices. The primary array is formed by a plurality of symbol-bearing reels. Each of the columns is occupied by a single one of the reels. The plurality of symbol-bearing reels is visually spun by at least one of one or more processors. In response to the occurrence of a triggering event, a feeder array of symbol positions arranged in one or more columns is displayed on the one or more display devices. Each of the symbol positions of the feeder array is associated with one of a plurality of feeder symbols. At least one of the feeder symbols is visually transferred by at least one of the one or more processors from the feeder array to the primary array of symbol positions such that each of the transferred feeder symbols is associated with a respective symbol position of the primary array for evaluation of a random outcome of the wagering game. The reels are stopped by at least one of the one or more processors from visually spinning such that the random outcome is indicated by both the symbol-bearing reels and the transferred feeder symbols.

Additional aspects of the present disclosure will be apparent to those of ordinary skill in the art in view of the detailed description of various implementations, which is made with reference to the drawings, a brief description of which is provided below.

Figure 1:
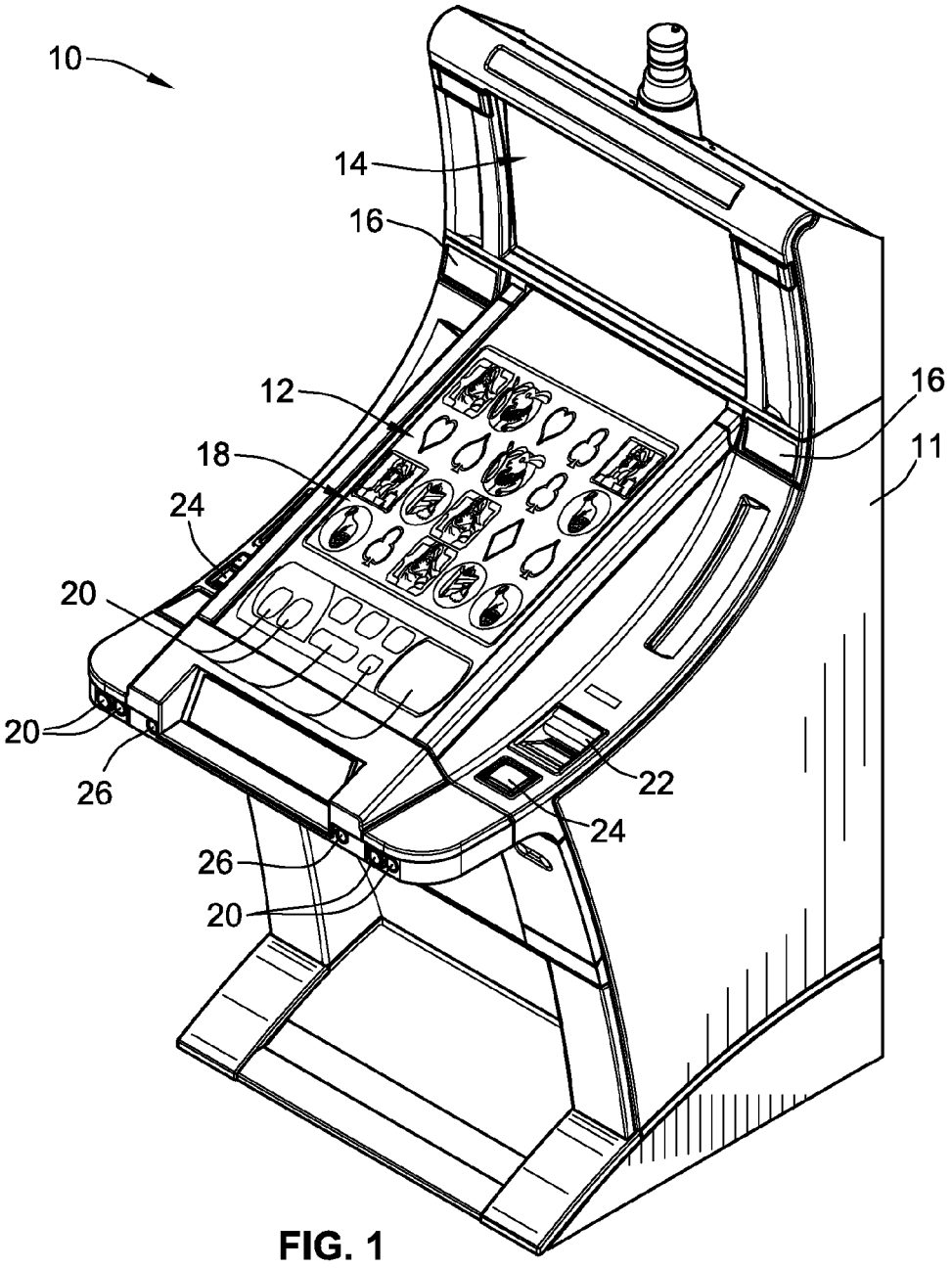
FIG. 1 is a perspective view of a free-standing gaming terminal according to some aspects of the present disclosure.

While the present disclosure is susceptible to various modifications and alternative forms, specific implementations have been shown by way of example in the drawings and will be described in detail herein. It should be understood, however, that the present disclosure is not intended to be limited to the particular forms disclosed. Rather, the disclosure is to cover all modifications, equivalents, and alternatives falling within the spirit and scope of the present invention as defined by the appended claims.

DETAILED DESCRIPTION

While this disclosure is susceptible of embodiment in many different forms, there is shown in the drawings and will herein be described in detail preferred embodiments of the disclosure with the understanding that the present disclosure is to be considered as an exemplification of the principles of the disclosure and is not intended to limit the broad aspect of the disclosure to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Referring to FIG. 1, there is shown a gaming terminal 10 similar to those used in gaming establishments, such as casinos. With regard to the present disclosure, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0069160 and US2010/0234099, which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
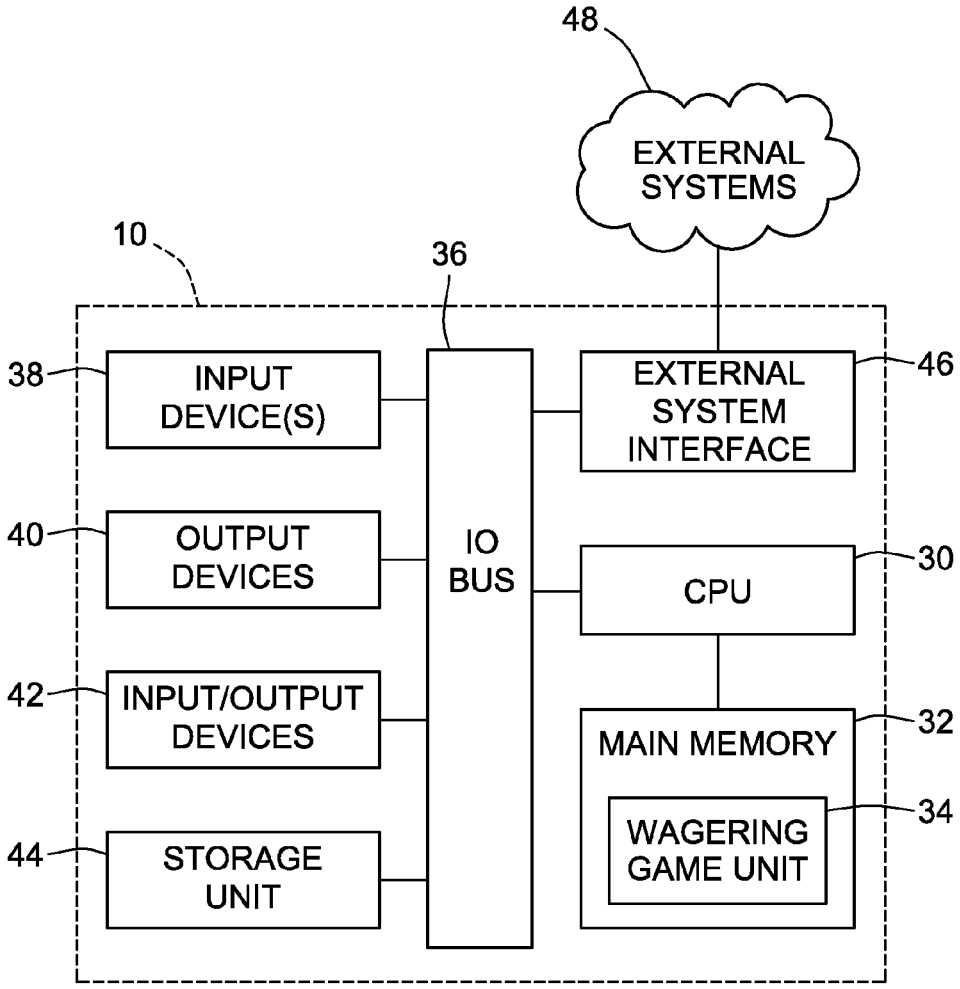
FIG. 2 is a schematic view of a gaming system according to some aspects of the present disclosure.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
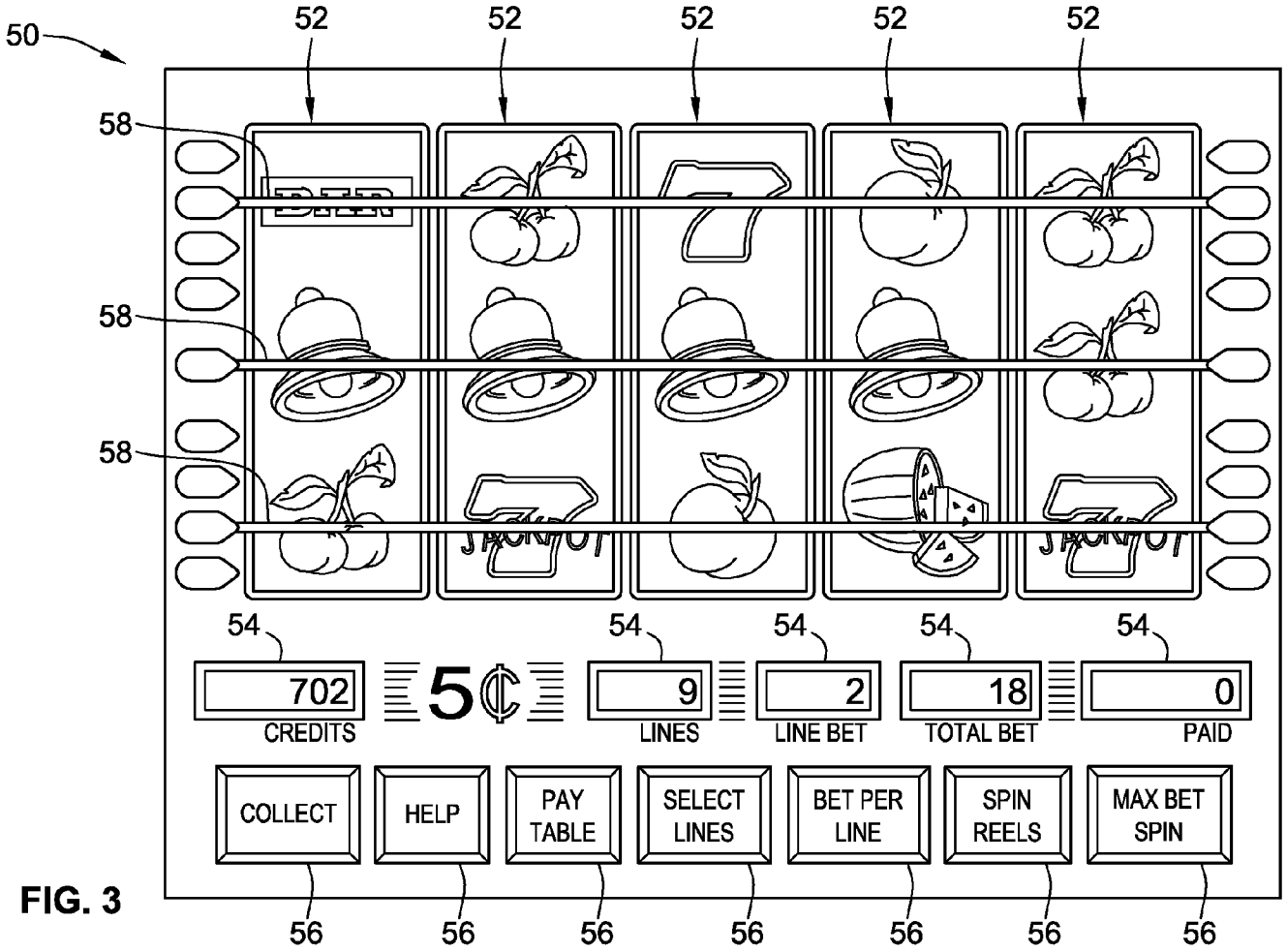
FIG. 3 is an image of an exemplary basic-game screen of a wagering game displayed on a gaming terminal according to some aspects of the present disclosure.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4:
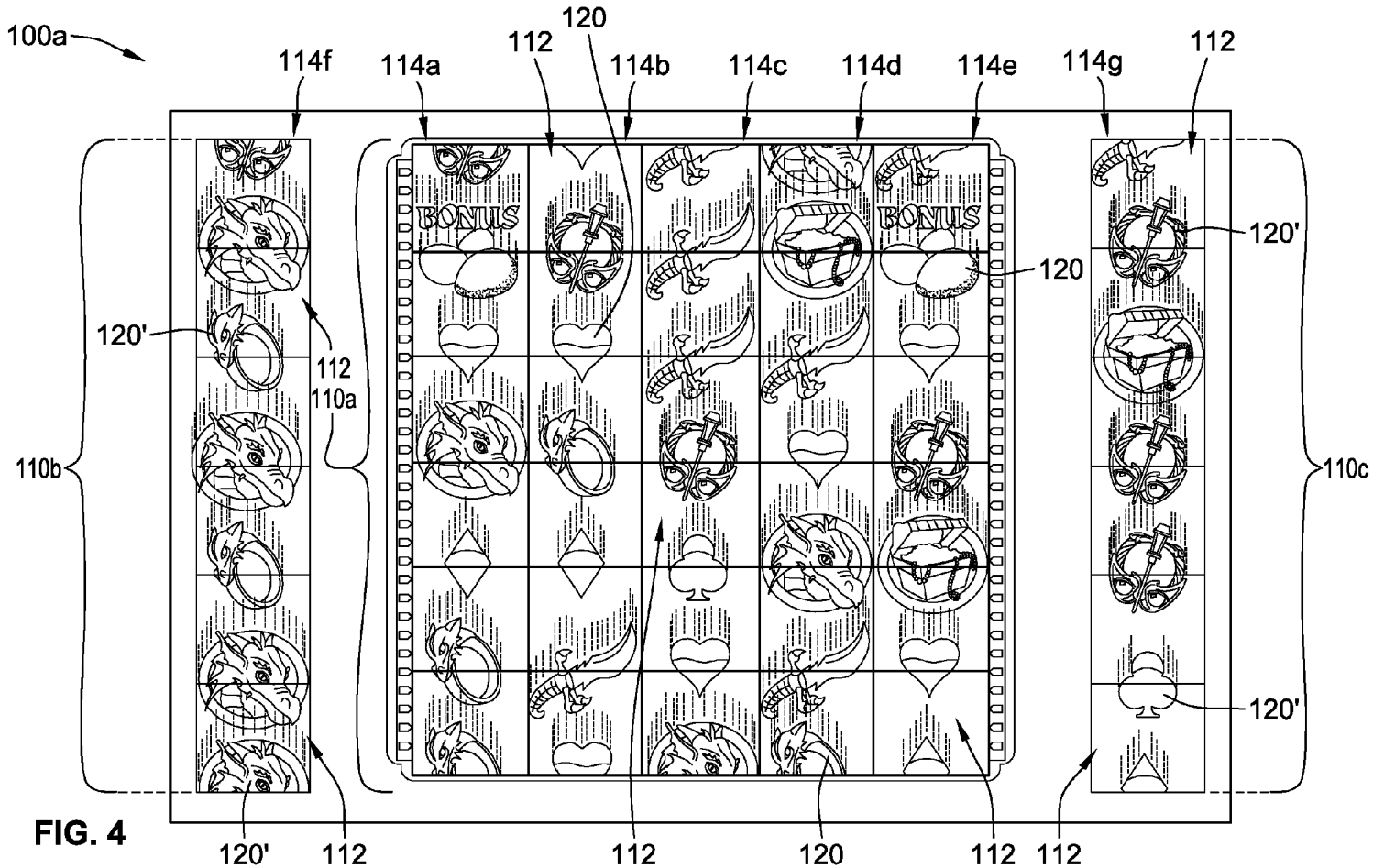
FIGS. 4-9B are screenshots of a display of the free-standing gaming terminal of FIG. 1 including a primary array and two secondary arrays according to various aspects of the present disclosure.
Figure 5:
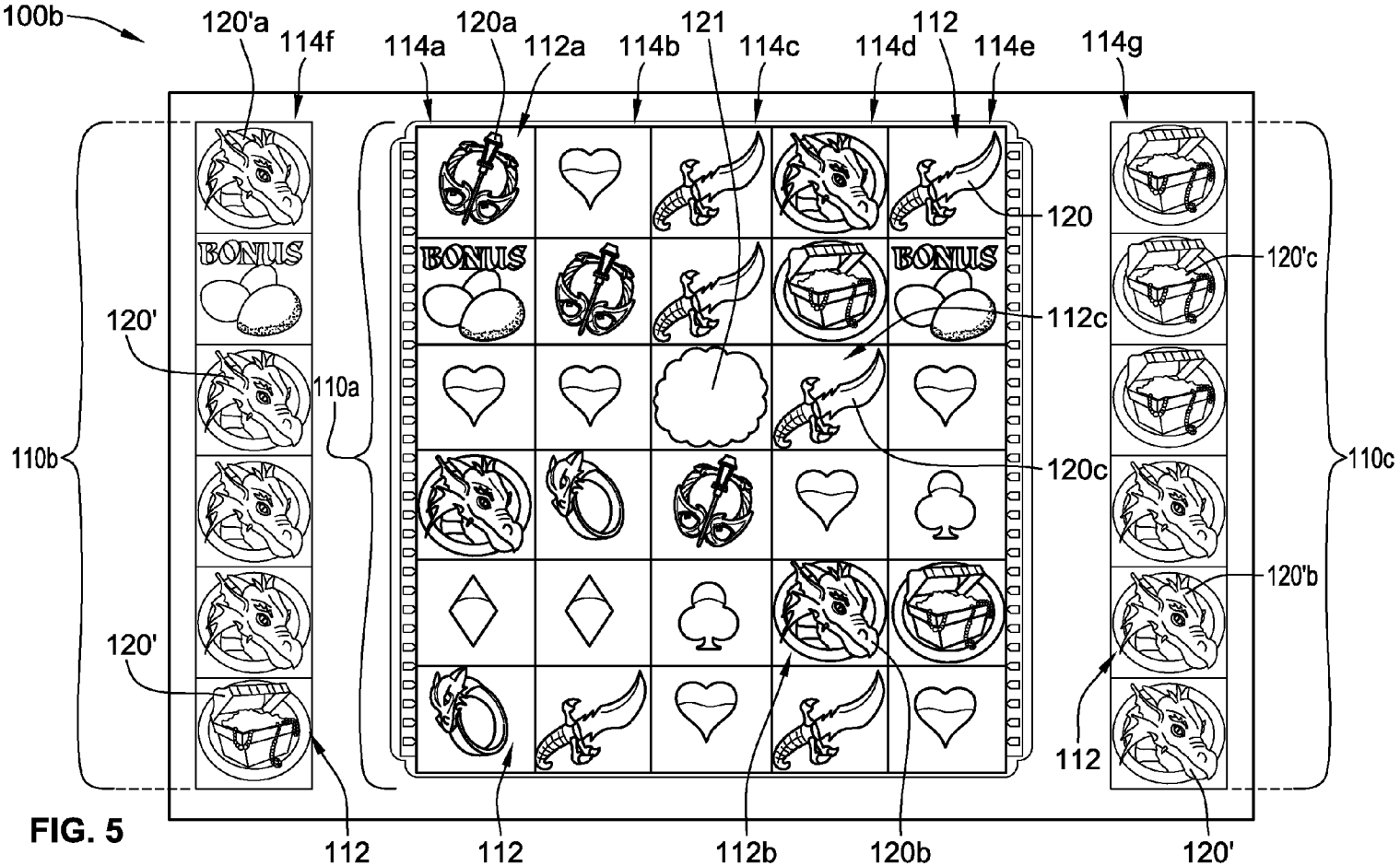
Figure 6:
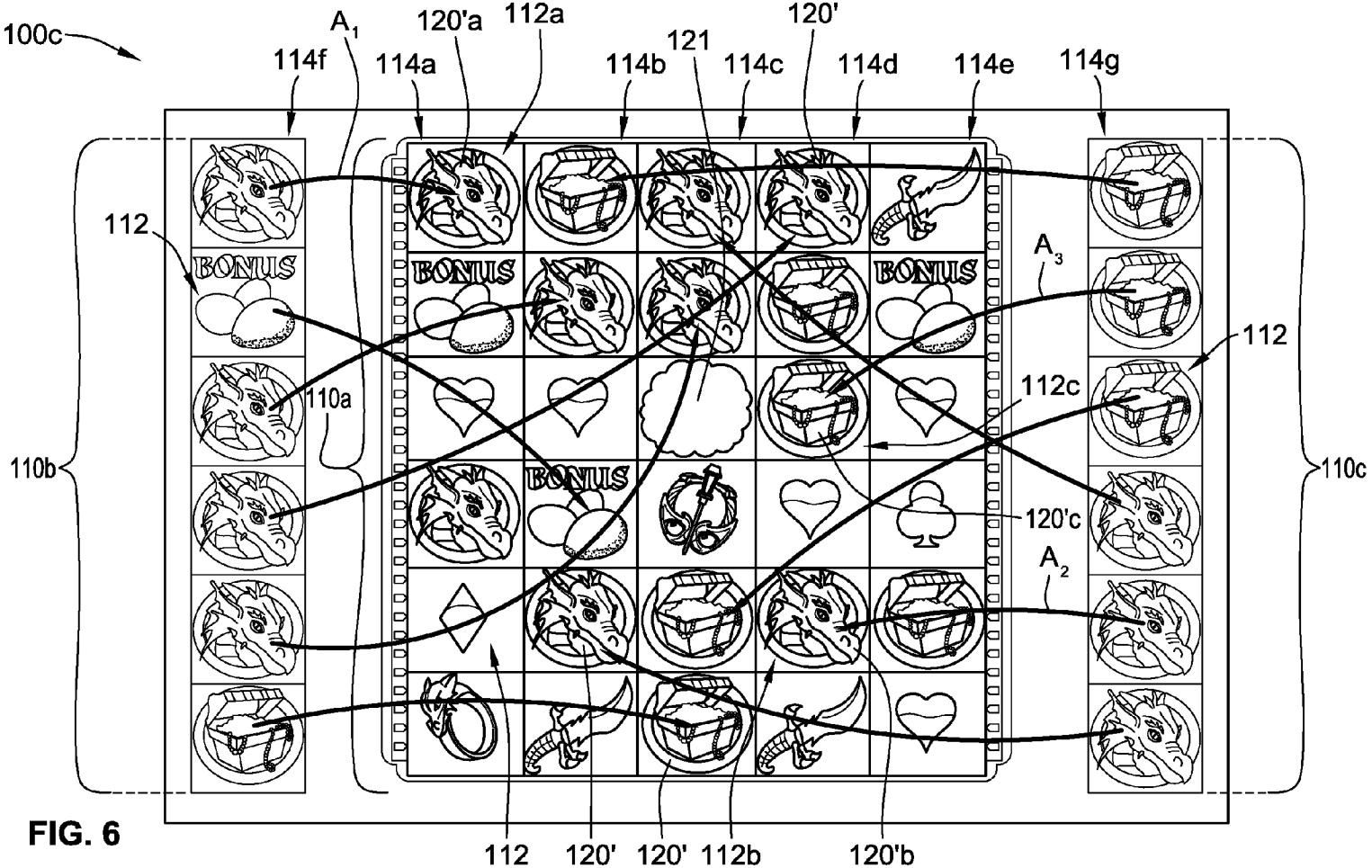

The primary display area 12 and/or the secondary display area 14 can be used for displaying one or more portions of a wagering game. Referring generally to FIGS. 4-6, screen shots 100*a*-100*c* of the primary display area 12 and/or the secondary display area 14 illustrate one play of a wagering game according to some aspects of the disclosed concepts. Generally, one play of the wagering game provides two or more arrays of symbol positions including spinning symbol-bearing reels (FIG. 4). A first random outcome for one of the arrays is evaluated (FIG. 5). If the first outcome includes a special symbol, then one or more feeder symbols are visually transferred (e.g., by one or more processors of the gaming terminal 10) into the array from the other array(s), thereby modifying the previous outcome (FIG. 6). The modified outcome, including the transferred symbols, is then evaluated (FIG. 6). The evaluation of the modified outcome during the play of the wagering game provides a player with an opportunity to win additional credits and/or other awards (e.g., multipliers, free plays, etc.) during the same play of the wagering game (e.g., without having to make an additional wager), thereby adding excitement and anticipation to playing the wagering game of the present disclosure. Various triggering methods, symbol transferring methods, and outcome modification methods are possible, several of which are disclosed in further detail herein.

Referring specifically to FIG. 4, the screenshot 100*a* includes a primary array of symbol positions 110*a* and two feeder arrays of symbol positions 110*b* and 110*c* used in conducting the wagering game. The primary array of symbol positions 110*a* is a 6×5 matrix of symbol positions 112 arranged in five columns 114*a-e* and six rows (i.e., thirty symbol positions 112). The primary array 110*a* is formed by a plurality of symbol-bearing reels such that each of the columns 114*a-e* is occupied by a single one of the reels and each of the reels bears at least a portion of a plurality of symbols 120. The symbol-bearing reels can be mechanical reels, displayed simulated reels, or a combination thereof. While the primary array 110*a* is shown as including five columns 114*a-e* and six symbol positions 112 per column, any number of columns and rows can be provided. For example, the primary array can include 2, 3, 4, 5, 6, 7, 10, 20, n, etc. columns with 1, 2, 3, 5, 10, m, etc. rows.

A first one of the feeder arrays 110*b* is a 6×1 matrix of symbol positions 112 arranged in a single column 114*f* and six rows (i.e., six symbol positions 112). Similarly, a second one of the feeder arrays 110*c* is a 6×1 matrix of symbol positions 112 arranged in a single column 114*g* and six rows (i.e., six symbol positions 112). Like the primary array 110*a*, each of the feeder arrays 110*b* and 110*c* is formed by a symbol-bearing reel such that each of the columns 114*f* and 114*g* is occupied by a single reel bearing at least a portion of a plurality of feeder symbols 120'. The plurality of feeder symbols 120' can include all of, or a portion of, the same symbols in the plurality of symbols 120. While each of the feeder arrays 110*b* and 110*c* is shown as including a single column 114*f* and 114*g* and six symbol positions 112 per column, any number of columns and rows can be provided in any orientation (e.g., scattered symbols not in a structured array). For example, each of the feeder arrays can include 1, 2, 3, 4, 5, 6, 7, 10, 20, n, etc. columns with 1, 2, 3, 5, 10, m, etc. rows.

As shown in FIG. 4, while the gaming terminal 10 (FIG. 1) conducts a play of the wagering game, each of the columns 114*a-e* of the primary array 110*a* and each column 114*f* and 114*g* of the feeder arrays 110*b* and 110*c*, or each of the symbol-bearing reels, spins or illustrates a simulated spin to appear as if each of the columns 114*a-e*, 114*f*, and 114*g* is spinning prior to stopping (FIG. 5) and displaying a first random outcome of symbols. At the beginning of a play of the wagering game, all of the columns 114*a-g* spin and then stop spinning in a predetermined order (e.g., the first column 114*a* stops spinning first and displays its outcome, then the second column 114*b* stops and displays its outcome, etc.). As each column 114*a-g* stops spinning, a portion of a random outcome of symbols is displayed on the primary display area 12 and/or the secondary display area 14.

Referring to FIG. 5, after all of the columns 114*a-g* stop spinning, a first random primary outcome of symbols 120 is provided by the primary array (e.g., columns 114*a-e*) and two feeder outcomes of feeder symbols 120' are provided by the feeder arrays 110*b* and 110*c* (e.g., columns 114*f* and 114*g*, respectively). The first primary outcome is evaluated (e.g., by one or more processors of the gaming terminal 10) to determine if it is a winning outcome. If the first primary outcome is a winning outcome, an award is provided to the player of the wagering game, such as, for example, credits based on a value associated with the winning outcome in the pay table. Alternatively, the first primary outcome is not evaluated to determine if it is a wining outcome and the play of the wagering continues as described herein.

As shown in the example of FIG. 5, the first primary outcome includes a special symbol or a symbol-transfer trigger symbol 121. The presence of the special symbol 121 in the first primary outcome triggers the visual transfer of one or more of the feeder symbols 120' from one or both of the feeder arrays 110*b* and 110*c* into the primary array 110*a*. The transferring in of the one or more feeder symbols 120' modifies the first primary outcome into a second primary outcome, which is shown in FIG. 6.

All of the feeder symbols 120' associated with the first and second feeder arrays 110*b* and 110*c* are transferred into the primary array 110*a* (as illustrated by the arrows of FIG. 6). Specifically, each of the feeder symbols 120' is randomly associated with one of the symbol positions 112 of the primary array 110*a* and visually replaces the symbol 120 previously associated with that symbol position 112. The visual transfer results in each of the symbol positions 112 of the primary array 110*a* being associated with a single symbol from the plurality of symbols 120 or from the plurality of feeder symbols 120', thereby forming a second primary outcome.

Specifically, as shown in the example of FIG. 6, a first one of the feeder symbols 120'*a* (FIGS. 5 and 6) is randomly associated with a first one of the symbol positions 112*a* (FIGS. 5 and 6) of the primary array 110*a* and visually replaces a first one of the symbols 120*a* (FIG. 5), which is illustrated by arrow $A_1$ of FIG. 6. Similarly, for example, a second one of the feeder symbols 120'*b* (FIGS. 5 and 6) is randomly associated with a second one of the symbol positions 112*b* (FIGS. 5 and 6) of the primary array 110*a* and visually replaces a second one of the symbols 120*b* (FIG. 5), which is illustrated by arrow $A_2$ of FIG. 6; and a third one of the feeder symbols 120'*c* (FIGS. 5 and 6) is randomly associated with a third one of the symbol positions 112*c* (FIGS. 5 and 6) of the primary array 110*a* and visually replaces a third one of the symbols 120*c* (FIG. 5), which is illustrated by arrow $A_3$ of FIG. 6, etc.

After each of the feeder symbols 120' is transferred into the primary array 110*a* and associated with a symbol position 112 of the primary array 110*a*, the second primary outcome is provided as shown in FIG. 6, which is evaluated to determine if it is a winning outcome. If the second primary outcome is a winning outcome, an award is provided to the player of the wagering game, such as, for example, credits based on a value associated with the winning outcome in the pay table. The award provided for the second outcome can be less than, the same as, or greater than any award provided to the player in conjunction with the first primary outcome. The evaluation of the first and/or second primary outcome of the wagering game can include the evaluation of the special symbol 121 as a wild symbol, a high paying symbol, a mystery symbol, or a dedicated trigger symbol (e.g., no value associated on the pay table).

The transfer of the feeder symbols 120' to modify the first primary outcome of the wagering game can add excitement and anticipation for the player of the wagering game by only including certain symbols in the feeder arrays 110*b* and 110*c*. For example, the feeder symbols 120' associated with the symbol positions 112 of the feeder arrays 110*b* and 110*c* can include one or more clumps of the same symbol. Thus, the transfer in of the clumps of like symbols from the feeder arrays 110*b* and 110*c* results in the same or like symbols being added into the primary array 110*a* to be evaluated. As more like symbols 120 and 120' can result in more winning combinations with higher awards/payouts, such a transfer is desirable by players. Alternatively, for example, the feeder symbols 120' associated with the symbol positions 112 of the feeder arrays 110*b* and 110*c* can include high paying symbols, wild symbols, bonus symbols, mystery symbols, or a combination thereof, which are also desirable by players.

Additionally and/or alternatively to the clumps and/or high paying symbols, wild symbols, bonus symbols, and mystery symbols, the feeder symbols 120' associated with the symbol positions 112 of the feeder arrays 110*b* and 110*c* can include a subset of symbols of the plurality of symbols 120. For example, the plurality of symbols 120 can include five or more different symbols and the feeder symbols 120' can include three or fewer different symbols (e.g., two, one).

Figure 7:
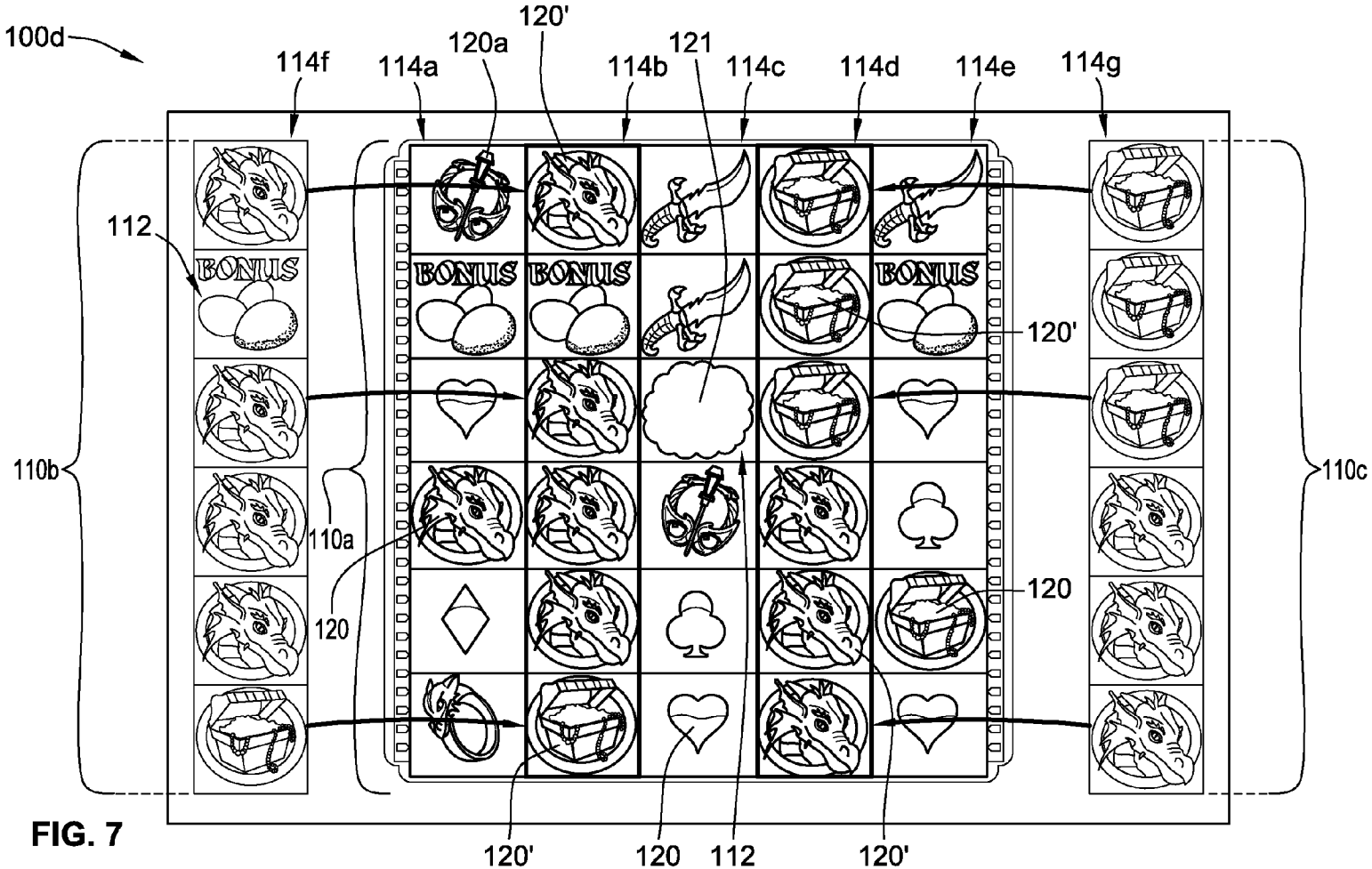

Although the transfer of the feeder symbols 120' into the primary array is described as being random and as including all of the feeder symbols 120', various other methods of transferring feeder symbols 120' from one or more feeder arrays into a primary array are possible. For example, as shown in a screenshot 100*d* of FIG. 7, an alternative method of visually transferring (e.g., by one or more processors of the gaming terminal 10) the feeder symbols 120' and modifying the first primary outcome into the second primary outcome includes visually replacing one or more of the columns (e.g., columns 114*a-e*) of the primary array 110*a* with the columns (e.g., columns 114*f* and/or 114*g*) of the feeder arrays 110*b* and 110*c* such that all of the feeder symbols 120' associated with the feeder arrays 110*b* and 110*c* are transferred into the primary array 110*a*. Specifically, as shown, for example, the first feeder array 110*b* replaces the second column 114*b* of the primary array 110*a* and the second feeder array 110*c* replaces the fourth column 114*d* of the primary array 110*a*.

While the columns 114*f* and 114*g* of the feeder arrays 110*b* and 110*c* can replace any one or more of the columns 114*a-e* of the primary array, as shown, the replaced columns 114*b* and 114*d* of the primary array are directly adjacent to the third column 114*c*, which includes the symbol position 112 that is associated with the special symbol 121. In addition to replacing the columns 114*b* and 114*d*, the feeder arrays 110*b* and 110*c* can be transferred such that the feeder symbols 120' maintain the same orientation as in the feeder arrays 110*b* and 110*c* prior to the transferring.

Figure 8:
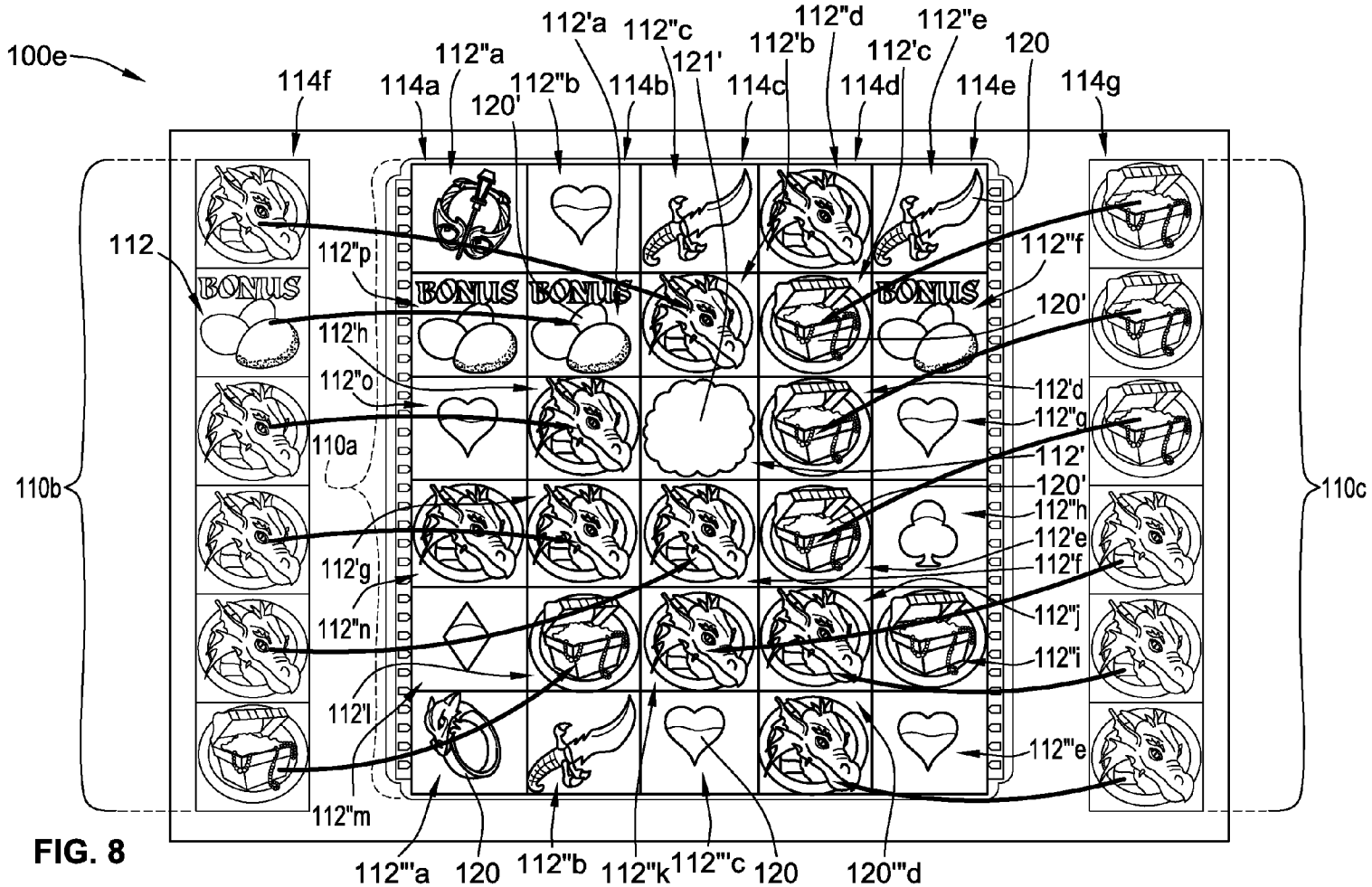

Referring to a screenshot 100*e* of FIG. 8, an alternative method of visually transferring (e.g., by one or more processors of the gaming terminal 10) the feeder symbols 120' and modifying the first primary outcome into the second primary outcome includes a special magnetic symbol 121'. The special magnetic symbol 121' is similar to the special symbol 121 described above, but further acts as a magnetic symbol with simulated magnetic-like properties (e.g., attraction of objects such as feeder symbols 120'). The special magnetic symbol 121' attracts the feeder symbols 120' toward its associated symbol position 112' during the visually transferring of the feeder symbols 120' such that the feeder symbols 120' that are transferred into the primary array 110*a* are associated with ones of the symbol positions 112 that are adjacent to the symbol position 112' associated with and/or including the special magnetic symbol 121'.

The symbol position 112' associated with the special magnetic symbol 121' is surrounded by and directly adjacent to a first tier of symbol positions 112'*a-h*. Similarly, the first tier of symbol positions 112'*a-h* is surrounded and directly adjacent to a second tier of symbol positions 112"*a-p*. Depending on the size of the primary array 110*a*, a third tier of symbol positions, a fourth tier of symbol positions (not shown), etc. can be provided. For example, as shown, a portion of the second tier of symbol positions (symbol positions 112"*i-m*) is surrounded by and directly adjacent to a third tier of symbol positions 112'''*a-e*.

Depending on one or more of (1) the number of feeder symbols 120' transferred into the primary array 110*a* from the feeder arrays 110*b* and 110*c* (which can be all of or a portion of the feeder symbols 120'), (2) the location of the symbol position 112' associated with the special magnetic symbol 121' within the primary array 110*a*, and (3) the orientation of the primary array 110*a* and the feeder arrays 110*b* and 110*c*, the special magnetic symbol 121' attracts the feeder symbols 120' such that the feeder symbols 120' are associated with at least a portion of the first tier of symbol positions 112'*a-h* and with at least a portion of the second tier of symbol positions 112"*a-p*. The simulated magnetic attraction strength of the special magnetic symbol 121' is stronger the closer a feeder symbol 120' is to the special magnetic symbol 121'. Thus, as each of the feeder symbols 120' is visually transferred into the primary array 110*a*, each of the first tier of symbol positions 112'*a-h* has a higher probability of being associated with one of the feeder symbols 120' than each of the second tier of symbol positions 112"*a-p*. Similarly, each of the second tier of symbol positions 112"*a-p* has a higher probability of being associated with one of the feeder symbols 120' than each of the third tier of symbol positions 112'''*a-e*, etc.

The association of the feeder symbols 120' with ones of the symbol positions 112 of the primary array 110*a* can be based on simulated magnetic-like properties, where the feeder symbols 120' act as metal objects and the special magnetic symbol 121' acts as a magnet that attracts the feeder symbols 120' towards symbol positions 112 adjacent to the symbol position 112' associated with the special magnetic symbol 121'. Thus, depending on the number of transferred feeder symbols 120', the position of the special magnetic symbol 121', and the orientation of the arrays 110*a-c* (e.g., the second feeder array 110*c* can be positioned above the primary array 110*a*, which is not shown), not all of the first tier of symbol positions 112'*a-h* will necessarily be associated with one of the feeder symbols 120'. Similarly, by the same logic, not all of the second and/or third tier of symbol positions 112"*a-p* and 112'''*a-e* will necessarily be associated with one of the feeder symbols 120'.

In addition to the simulated magnetic-like properties of the special magnetic symbol 121' acting on the feeder symbols 120' to attract them to the surrounding symbol positions as described herein, each of the transferred feeder symbols 120' can be visually transferred to and associated with a symbol position 112 of the primary array 110*a* based on a lineal distance of the feeder symbol 120'. For example, the feeder symbols 120' can be transferred to available (e.g., not previously associated with another one of the feeder symbols 120') ones of the first tier of symbol positions 112'*a-h* that are closest to the feeder symbol 120' prior to being transferred, then to the closest available one of the second tier of symbol positions 112"*a-p*, etc. That is, for example, a feeder symbol 120' in the first feeder array 110*b* can be transferred to an available one of the first tier of symbol positions 112'*a-h* that has the shortest distance between the symbol position 112 associated with the feeder symbol 120' and the available one of the first tier of symbol positions 112'*a-h*.

As shown in FIG. 8, in some implementations of such a concept including the special magnetic symbol 121', each of the first tier of symbol positions 112'*a-h* is associated with one of the feeder symbols 120', three of the second tier of symbol positions 112"*j-l* are associated with the feeder symbols 120', and one of the third tier of symbol positions 112'"*d* is associated with a feeder symbol 120'.

Alternatively, the special magnetic symbol 121' can act upon the feeder symbols 120' in a more repeatable magnetic-like manner (not shown). For example, in some implementations, the special magnetic symbol 121' attracts the feeder symbols 120' such that one or more of the second tier of symbol positions 112"*a-p* is associated with respective ones of the feeder symbols 120' only if each of the first tier of symbol positions 112'*a-h* is associated with a feeder symbol 120'. Similarly, in such an alternative concept, the special magnetic symbol 121' attracts the feeder symbols 120' such that one or more of the third tier of symbol positions 112'" is associated with respective ones of the feeder symbols 120' only if each of the second tier of symbol positions 112"*a-p* is associated with a feeder symbol 120'.

Figure 9A:
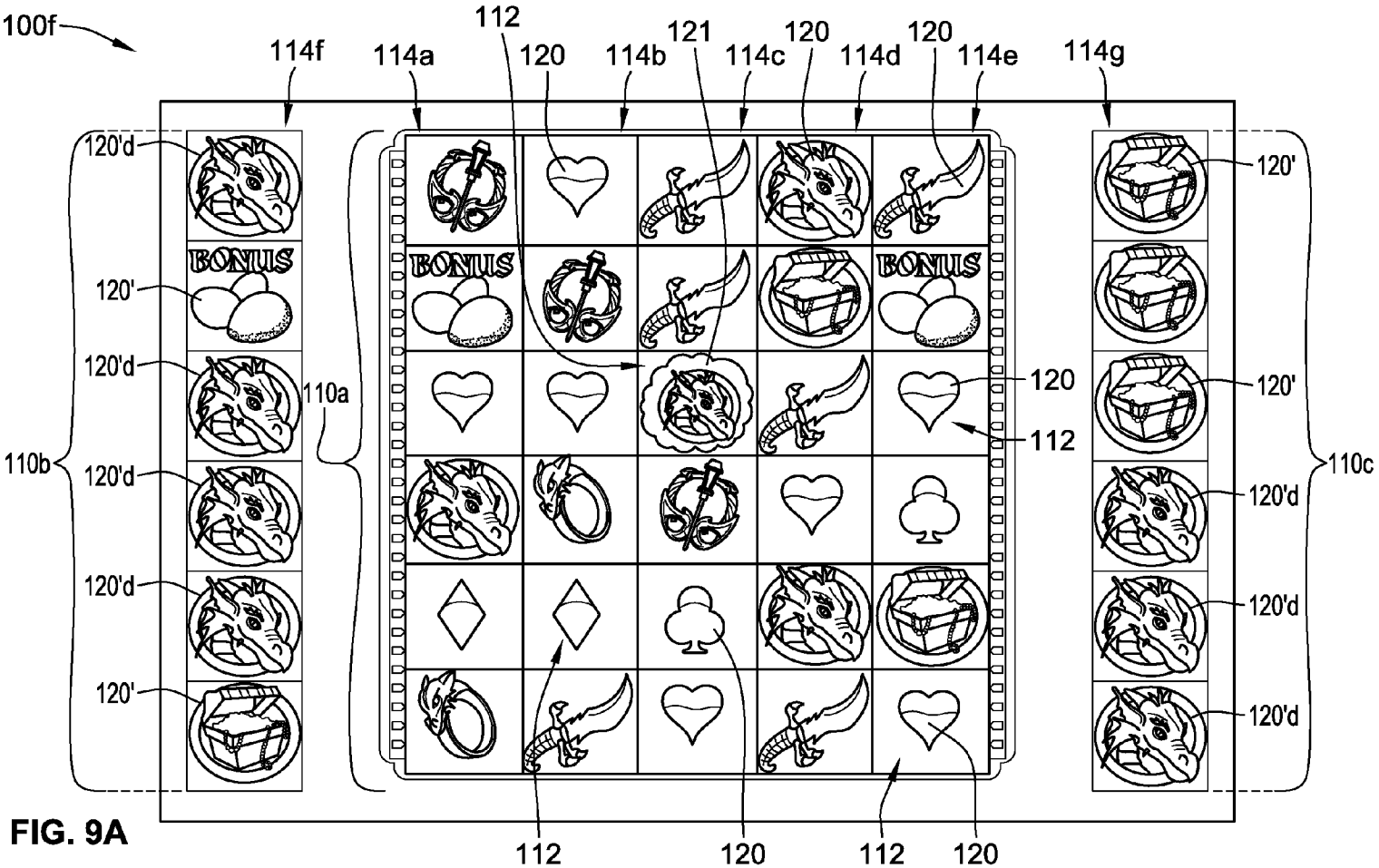

Referring to a screenshot 100*f* of FIG. 9A, an alternative method of visually transferring (e.g., by one or more processors of the gaming terminal 10) the feeder symbols 120' and modifying the first primary outcome into the second primary outcome includes randomly selecting (e.g., by one or more processors of the gaming terminal 10) one of the feeder symbols 120' to be transferred into the primary array 110*a*. In the illustrated example, the dragon feeder symbol 120'*d* (of the feeder symbols 120') is randomly selected as evidence by the visual transformation of the special symbol 121 to include a reproduction of the dragon feeder symbol 120'*d* within the special symbol 121 (as compared with the special symbol 121 of FIG. 5). One or more of the other feeder symbols 120' and/or symbols 120 can be randomly selected in lieu of, or in addition to, the dragon feeder symbol 120'*d* to be transferred into the primary array 110*a* from the feeder arrays 110*b* and 110*c*. Additionally, all of, or a portion of, the randomly selected symbol(s) can be transferred into the primary array 110*a* (e.g., less than all of the selected feeder symbols 120' can be transferred).

Figure 9B:
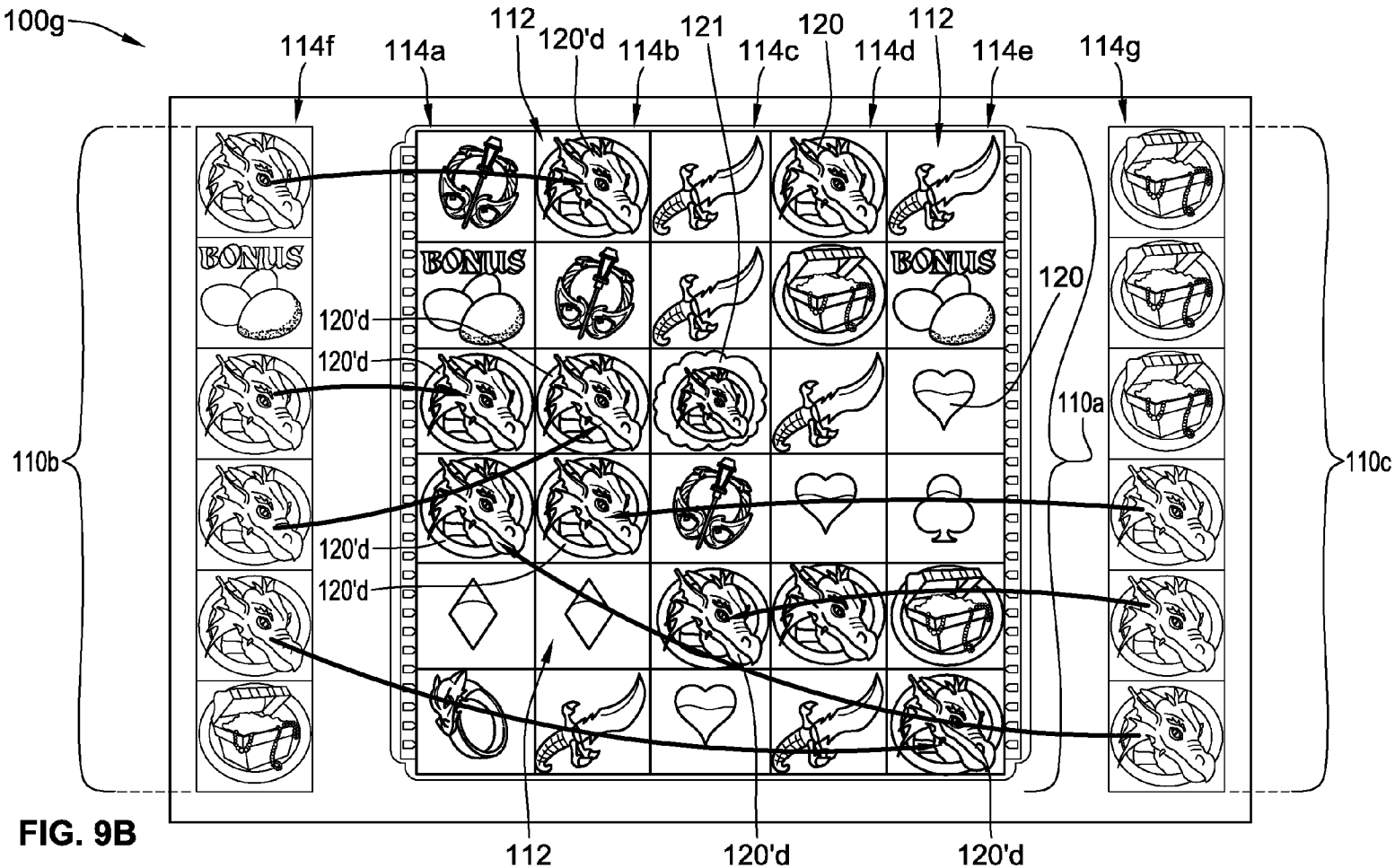

As shown in a screenshot 100*g* of FIG. 9B, all of the randomly selected dragon feeder symbols 120'*d* associated with the first and the second feeder array 110*b* and 110*c* (four from the first feeder array 110*b* and three from the second feeder array 110*c*) are visually transferred into the primary array 110*a*, thereby forming the second primary outcome. Specifically, each of the selected dragon feeder symbols 120'*d* is randomly associated with one of the symbol positions 112 of the primary array 110*a* and visually replaces the symbol 120 previously associated with that symbol position 112 (best shown by a comparison of FIG. 9A with 9B) such that each of the symbol positions 112 of the primary array 110*a* is associated with a single symbol from the plurality of symbols 120 (including the modified special symbol) or the dragon feeder symbols 120'*d*.

After each of the dragon feeder symbols 120'*d* is visually transferred (e.g., by one or more processors of the gaming terminal 10) into the primary array 110*a* and associated with a symbol position 112 of the primary array 110*a*, the second primary outcome is provided as shown in FIG. 9B, which is evaluated (e.g., by one or more processors of the gaming terminal 10) to determine if it is a winning outcome. If the second primary outcome is a winning outcome, an award is provided to the player of the wagering game, such as, for example, credits based on a value associated with the winning outcome in the pay table. The evaluation of the first and/or second outcome of the wagering game shown in FIGS. 9A and 9B can include the evaluation of the special symbol 121 as the randomly selected feeder symbol (e.g., the dragon feeder symbol 120'), a wild symbol, a high paying symbol, a mystery symbol, or a dedicated trigger symbol (e.g., no value associated on the pay table).

Figure 10:
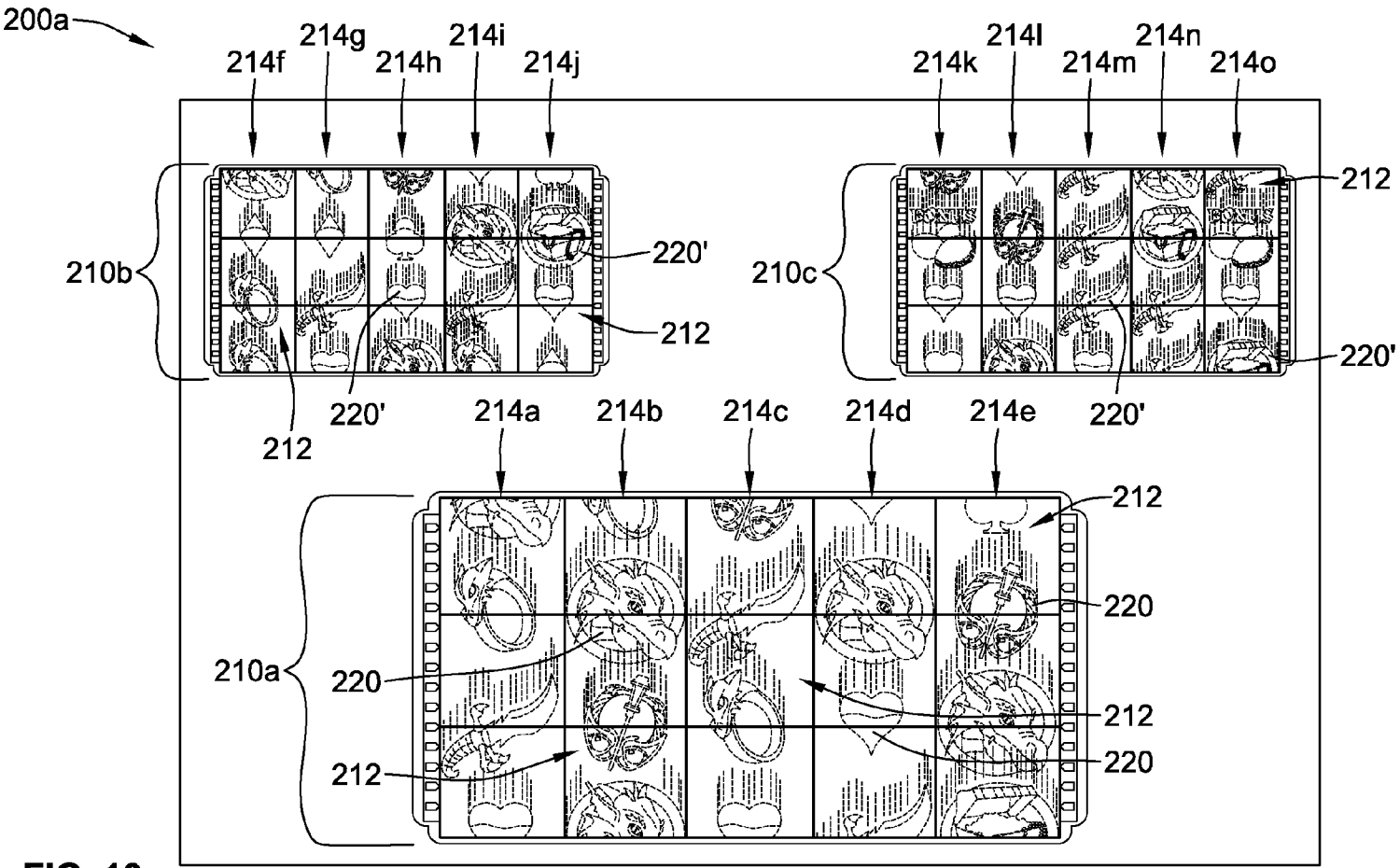
FIGS. 10-13C are screenshots of a display of the free-standing gaming terminal of FIG. 1 including a primary array and two secondary arrays according to other aspects of the present disclosure.

Referring generally to FIGS. 10-13A, screenshots 200*a*-200*d* of the primary display area 12 and/or the secondary display area 14 illustrate one play of a wagering game according to some aspects of the disclosed concepts. Referring specifically to FIG. 10, the screenshot 200*a* includes a primary array of symbol positions 210*a* and two feeder arrays of symbol positions 210*b* and 210*c* used in conducting the wagering game, which are similar to the primary array 110*a* and the feeder arrays 110*b* and 110*c* described above. The primary array of symbol positions 210*a* is a 3×5 matrix of symbol positions 212 arranged in five columns 214*a-e* and three rows (i.e., fifteen symbol positions 212). The primary array of symbol positions 210*a* is formed by a plurality of symbol-bearing reels such that each of the columns 214*a-e* is occupied by a single one of the reels and each of the reels bears at least a portion of a plurality of symbols 220. While the primary array 210*a* is shown as including five columns 214*a-e* and three symbol positions 212 per column, any number of columns and rows can be provided. For example, the primary array can include 2, 3, 4, 5, 6, 7, 10, 20, n, etc. columns with 1, 2, 3, 5, 10, m, etc. rows.

A first one of the feeder arrays 210*b* is a 3×5 matrix of symbol positions 212 arranged in a five columns 214*f-j* and three rows (i.e., fifteen symbol positions 212). Similarly, a second one of the feeder arrays 210*c* is a 3×5 matrix of symbol positions 212 arranged in five columns 214*k-o* and three rows (i.e., fifteen symbol positions 212). Like the primary array 210*a*, each of the feeder arrays 210*b* and 210*c* is formed by symbol-bearing reels such that each of the columns 214*f-j* and 214*k-o* is occupied by a single reel bearing at least a portion of a plurality of feeder symbols 220'. The plurality of feeder symbols 220' can include all of, or a portion of, the same symbols in the plurality of symbols 220. While each of the feeder arrays 210*b* and 210*c* is shown as including five columns 214*f-j* and 214*k-o* and three symbol positions 212 per column, any number of columns and rows can be provided. For example, each of the feeder arrays can include 1, 2, 3, 4, 5, 6, 7, 10, 20, n, etc. columns with 1, 2, 3, 5, 10, m, etc. rows.

Each of the feeder arrays 210*b* and 210*c* can be activated by a player of the wagering game prior to starting a play of the wagering game. Activating the feeder arrays 210*b* and/or 210*c* makes the feeder array(s) part of the play of the wagering game. In some aspects, non-activated feeder arrays are not shown to the player.

In order to activate one or both of the feeder arrays 210*b* and 210*c*, the player can make an additional wager. The additional wager can be a separate wager (e.g., a wager of coins or credits) from a primary wager made to play the wagering game, and/or the additional wager can be made in the form of a bet multiplier of the primary wager. For example, to play the wagering game based on outcomes of only the primary array 210*a*, a bet can be, for example, twenty credits. In order to activate the first feeder array 210*b*, an additional wager in the form of a bet multiplier of, for example, three or four is made (e.g., sixty or eighty credits), and in order to active both the first and the second feeder arrays 210*b* and 210*c* the additional wager in the form of the bet multiplier, for example, five or greater (e.g., one hundred credits) is made. Thus, in one example with a primary wager of twenty credits and a bet multiplier of six, the player wagers one hundred and twenty credits and activates both the first and the second feeder arrays 210*b* and 210*c*.

Once activated, each of the feeder arrays 210*b* and 210*c* operates independently from the primary array 210*a* in that each of the feeder arrays 210*b* and 210*c* spins and stops providing feeder outcomes (shown in FIG. 11) that are independent of, and at least partially different from, an outcome of the primary array 210*a*. The feeder outcomes of the activated feeder arrays 210*b* and 210*c* can be evaluated in the same manner as described herein regarding the evaluation of the outcomes of the primary array 110*a*. Alternatively, or in addition thereto, the feeder arrays 210*b* and 210*c* can be used for feeding one or more of the feeder symbols 220' into the primary array 210*a* thereby modifying the first primary outcome into a second primary outcome as described below.

Figure 11:
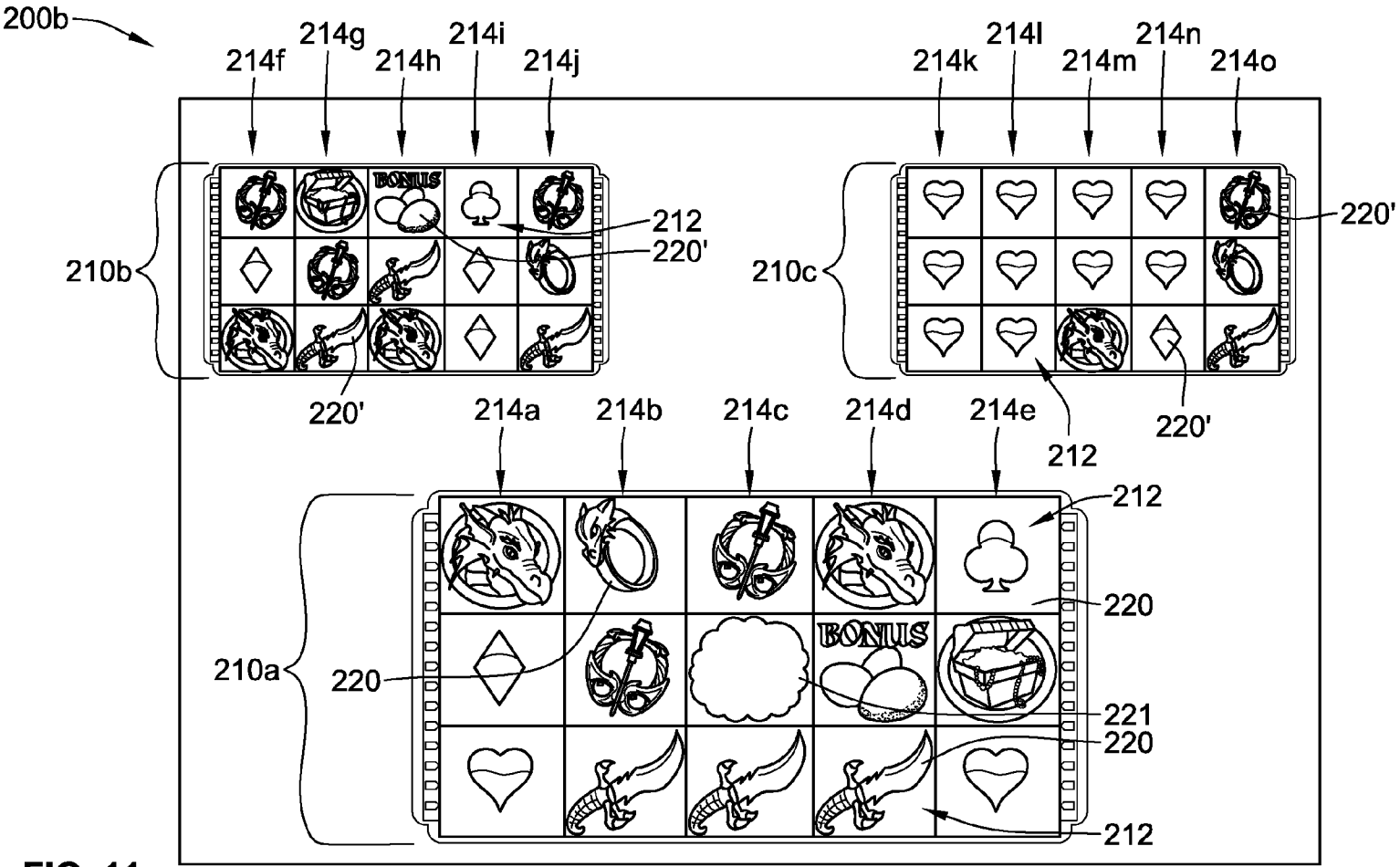
Figure 12:
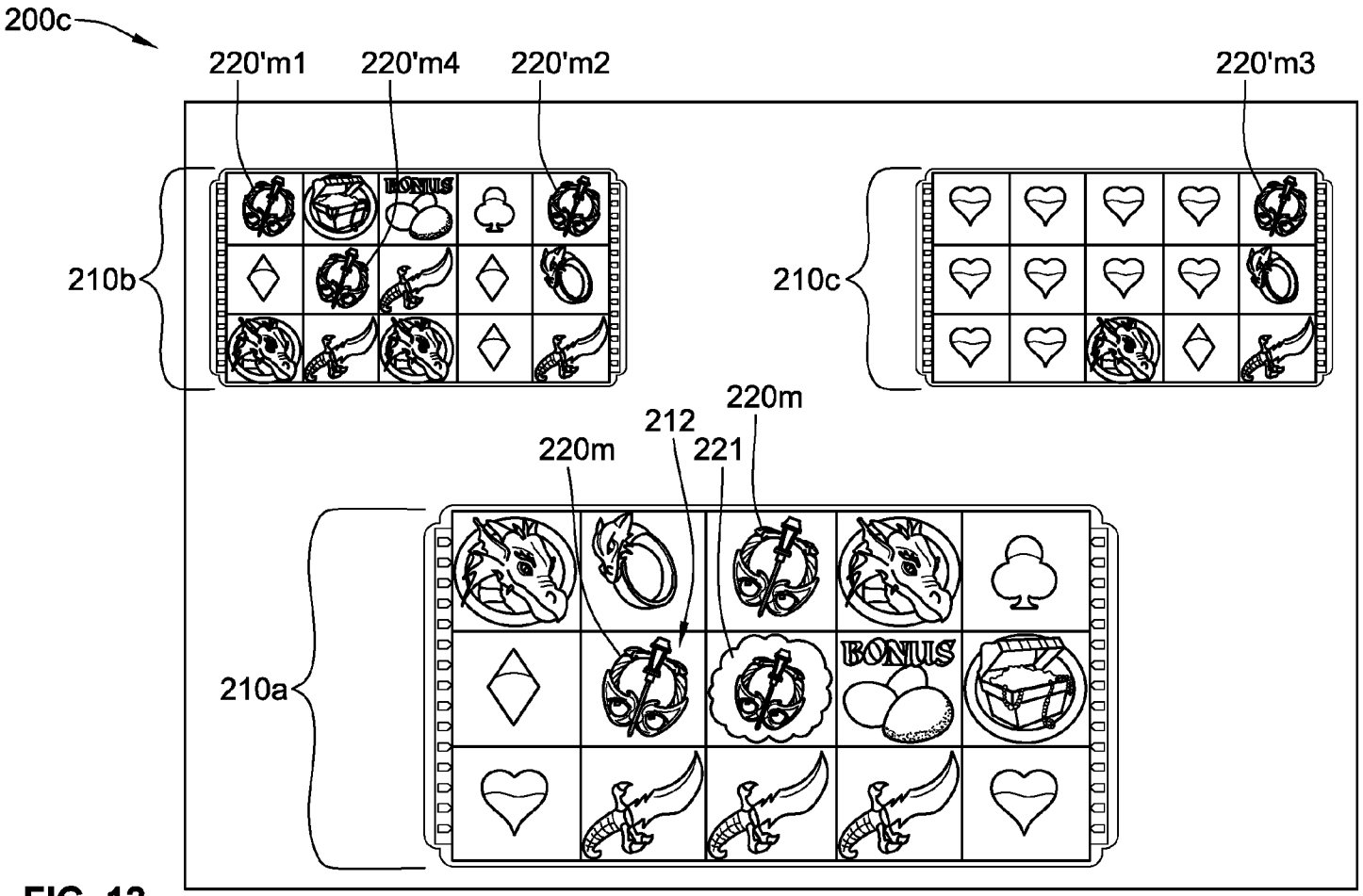

Assuming the first and the second feeder arrays 210*b* and 210*c* are activated, after each of the columns 214*a-o* stops spinning, the first primary outcome and two feeder outcomes are provided as shown in FIG. 11. Specifically, the first primary outcome is provided by the symbols 220 associated with the symbol positions 212 in the columns 214*a-e* of the primary array 210*a*. Similarly, a first feeder outcome is provided by the feeder symbols 220' associated with the symbol positions 212 in the columns 214*f-j* of the first feeder array 210*b* and a second feeder outcome is provided by the feeder symbols 220' associated with the symbol positions 212 in the columns 214*k-o* of the second feeder array 210*c*.

The first primary outcome is evaluated (e.g., by one or more processors of the gaming terminal 10) to determine if it is a winning outcome. If the first primary outcome is a winning outcome, an award is provided to the player of the wagering game, such as, for example, credits based on a value associated with the winning outcome in the pay table. As described above, one, both, or neither of the feeder outcomes can be evaluated to determine if either is a winning outcome.

As shown in the screenshot 200*b* of FIG. 11, the first primary outcome includes a special symbol or a symbol-transfer trigger symbol 221. The presence of the special symbol 221 in the first primary outcome triggers the visual transfer (e.g., by one or more processors of the gaming terminal 10) of one or more of the feeder symbols 220' from one or both of the feeder arrays 210*b* and 210*c* into the primary array 210*a* in the same, or similar, fashions as described herein in regards to the primary array 110*a* and the feeder arrays 110*b* and 110*c*. The transferring of the one or more feeder symbols 220' into the primary array 210*a* modifies the first primary outcome into the second primary outcome as shown in the screenshot 200*d* of FIG. 13A.

Prior to modifying the first primary outcome (FIG. 11) into the second primary outcome (FIG. 13A), one of the feeder symbols 220' is randomly selected (e.g., by one or more processors of the gaming terminal 10) to be transferred into the primary array 210*a* in the same, or similar, fashion as described herein in reference to FIGS. 9A and 9B. As shown in the screenshot 200*c* of FIG. 12, the mask feeder symbols 220'*m*1-4 are randomly selected as evidence by the visual transformation of the special symbol 221 (FIG. 11) to include a reproduction of the mask feeder symbol (shown in FIG. 12) within the special symbol 221. One or more of the other feeder symbols 220' and/or symbols 220 can be randomly selected in lieu of, or in addition to, the mask feeder symbols 220'*m*1-4 to be transferred into the primary array 210*a* from the feeder arrays 210*b* and 210*c*. Additionally, all of, or a portion of, the randomly selected symbol(s) can be transferred into the primary array 210*a* (e.g., less than all of the selected feeder symbols 220' can be transferred).

Figure 13A:
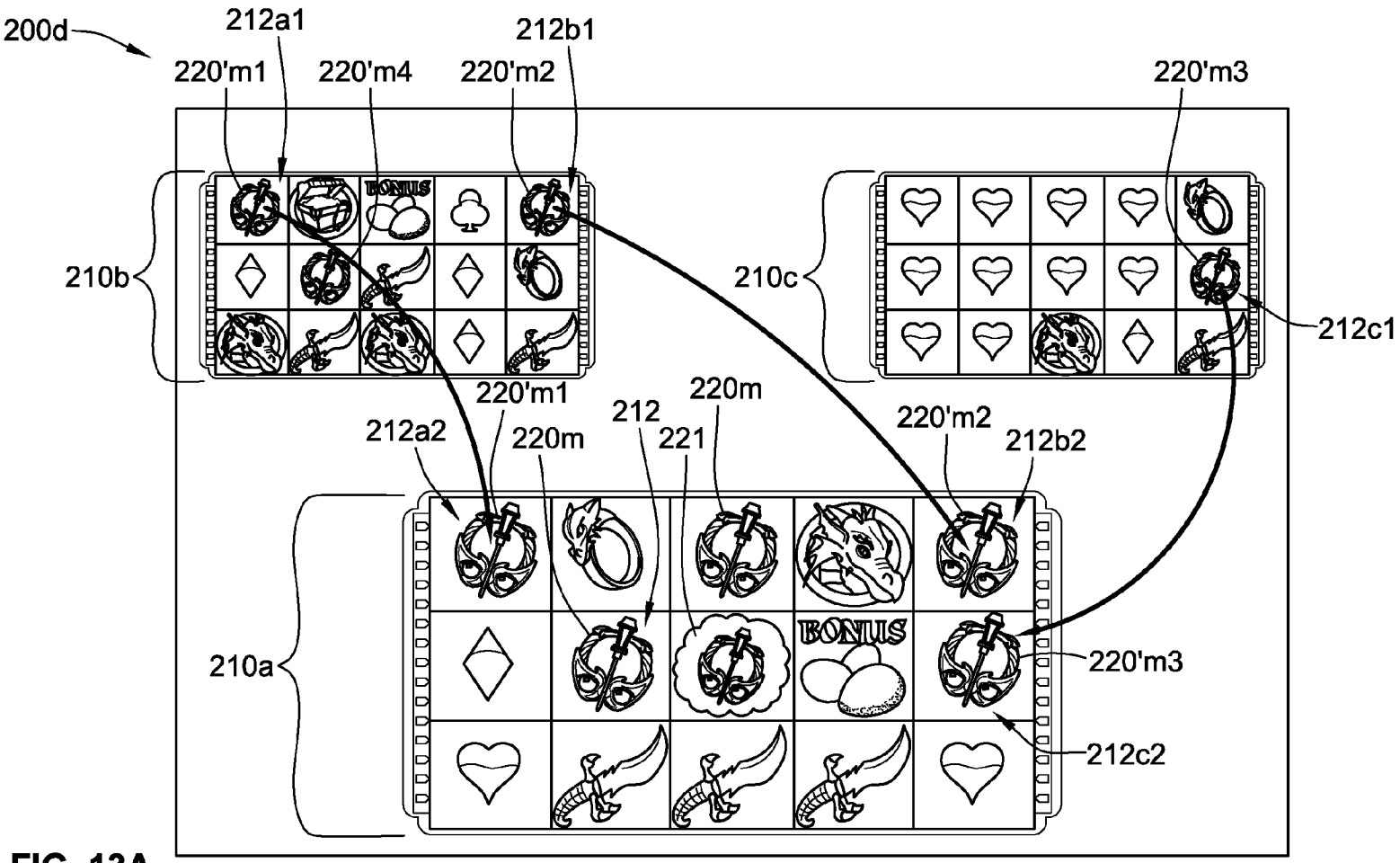
Figure 13B:
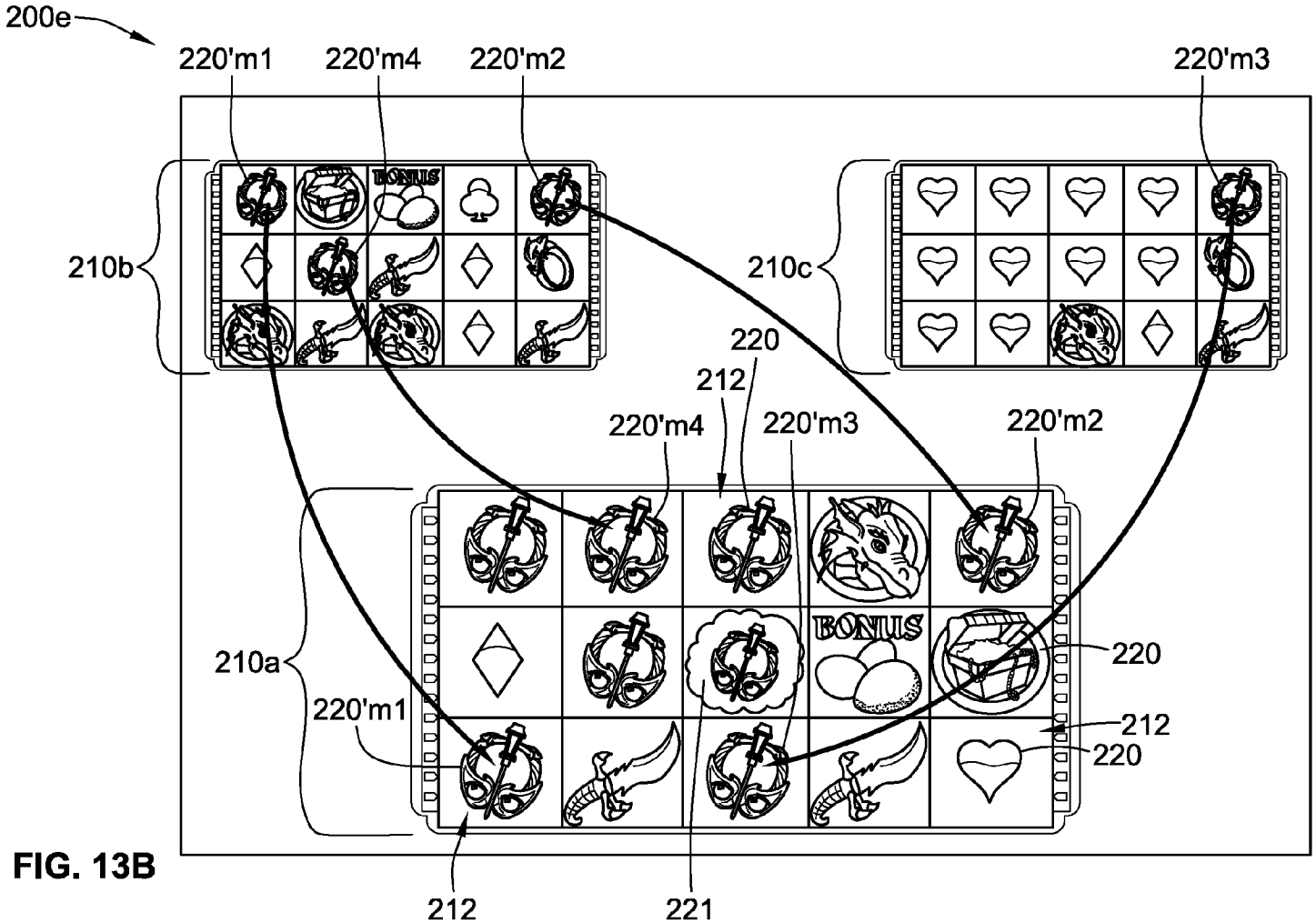

As shown in the screenshot 200*d* of FIG. 13A, three of the randomly selected mask feeder symbols 220'*m*1-3 associated with the feeder arrays 210*b* and 210*c* are visually transferred into the primary array 210*a*, thereby forming the second primary outcome. Specifically, each of the selected mask feeder symbols 220'*m*1-3 is visually transferred and associated with a corresponding one of the symbol positions 212 of the primary array 210*a* and visually replaces the symbol 220 previously associated with that corresponding symbol position 212, which is best shown by a comparison of FIGS. 12 and 13A.

As shown in the example of FIG. 13A, a first one of the mask feeder symbols 220'*m*1 is visually transferred from a first symbol position 212*a*1 of the first feeder array 210*b* to a first corresponding symbol position 212*a*2 of the primary array 210*a*. The first symbol position 212*a*1 of the first feeder array 210*b* corresponds to the same relative position of the first symbol position 212*a*2 of the primary array 210*a* (e.g., both are the first or top symbol position of the first or leftmost column). Similarly, a second one of the mask feeder symbols 220'*m*2 is visually transferred from a second symbol position 212*b*1 of the first feeder array 210*b* to a second corresponding symbol position 212*b*2 of the primary array 210*a* (e.g., both are the first or top symbol position of the fifth or rightmost column); and a third one of the mask feeder symbols 220'*m*3 is visually transferred from a third symbol position 212*c*1 of the second feeder array 210*c* to a third corresponding symbol position 212*c*2 of the primary array 210*a* (e.g., both are the second or middle symbol position of the fifth or rightmost column).

While the first feeder array 210*b* further includes a fourth mask feeder symbol 220'*m*4 (FIGS. 12 and 13A), the fourth mask feeder symbol 220'*m*4 is not shown as being transferred to the primary array 210*a* because the first primary outcome (FIG. 12) of the primary array 210*a* includes a mask symbol 220*m* of the plurality of symbols 220 in a corresponding symbol position 212 of the primary array 210*a*. Thus, the visual transfer of the fourth mask feeder symbol 220'*m*4 to its corresponding symbol position 212 of the primary array 210*a* is not necessary and not shown.

Alternatively, the fourth mask feeder symbol 220'*m* can be shown to visually transfer in the same, or similar, manner as the other mask feeder symbols 220'*m*1-3. Additionally, the fourth mask feeder symbol 220'*m* can be shown to visually transfer into the primary array 210*a* and modify the mask symbol 220*m* in the corresponding symbol position 212. For example, the fourth mask feeder symbol 220'*m* can modify the mask symbol 220*m* in the corresponding symbol position 212 such that it becomes enhanced (e.g., becomes a multiplier, becomes a higher paying symbol, becomes a wild symbol, becomes a bonus trigger, becomes a wild reel symbol, etc.)

After each of the mask feeder symbols 220'*m*1-3 is visually transferred into the primary array 210*a* and associated with a symbol position 212 of the primary array 210*a*, the second primary outcome (including the symbols 220 and 220'*m*1-3) is provided by the primary array 210*a*, as shown in FIG. 13A, which is evaluated to determine if it is a winning outcome. If the second primary outcome is a winning outcome, an award is provided to the player of the wagering game, such as, for example, credits based on a value associated with the winning outcome in the pay table. The evaluation of the first and/or second primary outcome of the wagering game shown in FIGS. 11-13A can include the evaluation of the special symbol 221 as the randomly selected feeder symbol (e.g., the mask feeder symbol), a wild symbol, a high paying symbol, a mystery symbol, or a dedicated trigger symbol (e.g., no value associated on the pay table).

Although the transfer of the feeder symbols 220' into the primary array 210*a* is described as being to corresponding symbol positions 212, various other methods of transferring the feeder symbols 220' are possible. For example, as shown in a screenshot 200*e* of FIG. 13B, an alternative method of visually transferring (e.g., by one or more processors of the gaming terminal 10) the selected mask feeder symbols 220'*m*1-4 and modifying the first primary outcome into the second primary outcome includes visually transferring the mask feeder symbols 220'*m*1-4 and randomly associating each of the mask feeder symbols 220'*m*1-4 with one of the symbol positions 212 of the primary array 210*a*. Specifically, each of the selected mask feeder symbols 220'*m*1-4 is randomly associated with one of the symbol positions 212 of the primary array 210*a* and visually replaces the symbol 220 previously associated with that symbol position 212 (best shown by a comparison of FIGS. 12 and 13B) such that each of the symbol positions 212 of the primary array 210*a* is associated with a single symbol from the plurality of symbols 220 or one of the mask feeder symbols 220'*m*1-4.

Figure 13C:
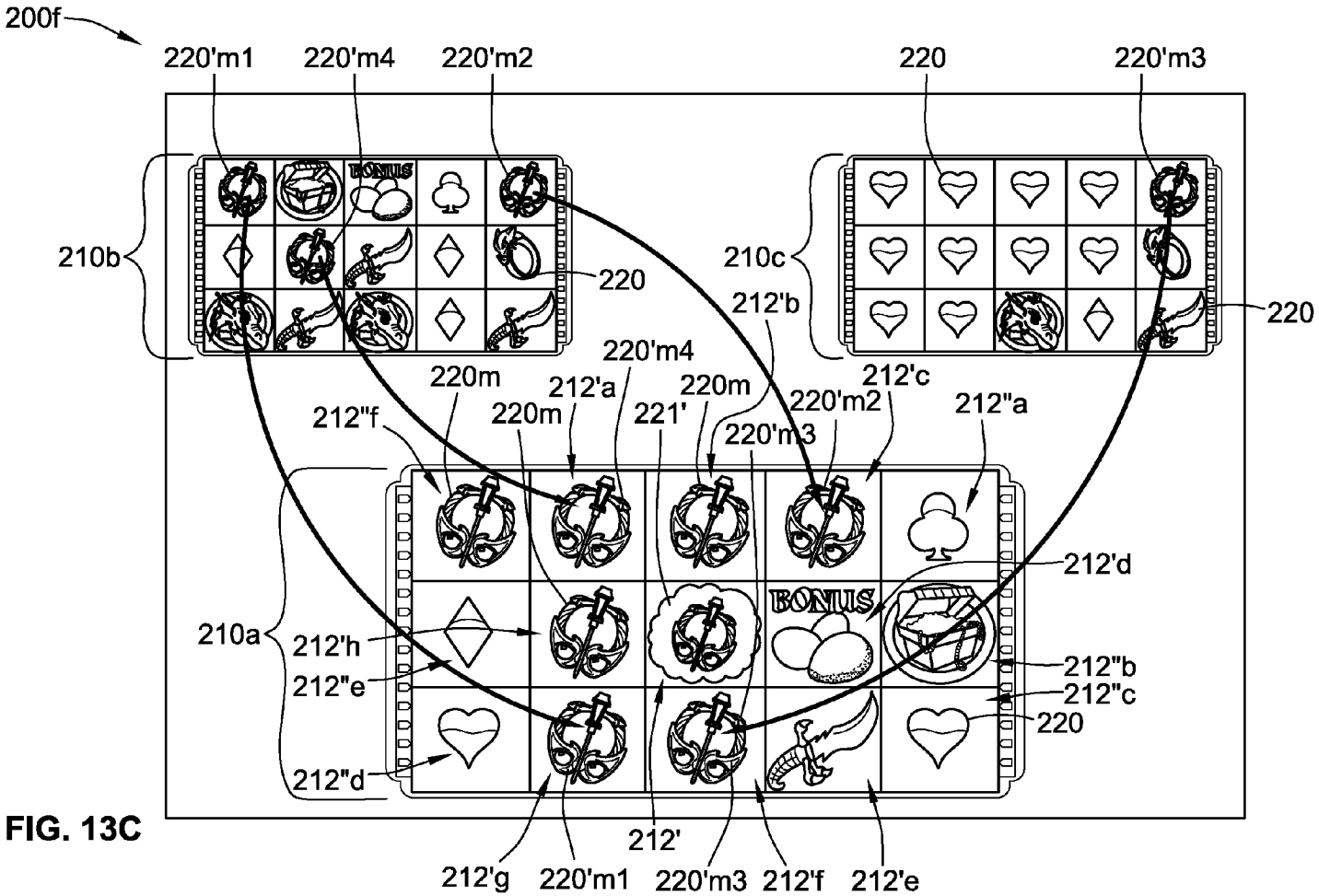

Referring to a screenshot 200*f* of FIG. 13C, an alternative method of visually transferring (e.g., by one or more processors of the gaming terminal 10) the feeder symbols 220' and modifying the first primary outcome into the second primary outcome includes a special magnetic symbol 221'. The special magnetic symbol 221' is the same as, or similar to, the special magnetic symbol 121' described above. The special magnetic symbol 221' attracts the transferred feeder symbols 220'*m*1-4 toward its associated symbol position 212' during the visually transferring of the feeder symbols 220'*m*1-4 such that the mask feeder symbols 220'*m*1-4 that are transferred into the primary array 210*a* are associated with ones of the symbol positions 212 that are adjacent to the symbol position 212' associated with and/or including the special magnetic symbol 221', in the same, or similar, fashions as the special magnetic symbol 121' described above in reference to FIG. 8.

The symbol position 212' associated with the special magnetic symbol 221' is surrounded by and directly adjacent to a first tier of symbol positions 212'*a-h*. Similarly, a portion the first tier of symbol positions 212'*a-h* is surrounded by and directly adjacent to a second tier of symbol positions 212"*a-f*. Depending on the size of the primary array 210*a*, a third tier of symbol positions (not shown), a fourth tier of symbol positions (not shown), etc. can be provided.

Depending on one or more of (1) the number of selected feeder symbols 220' (e.g., selected mask feeder symbols 220'*m*1-4) transferred into the primary array 210*a* from the feeder arrays 210*b* and 210*c*, (2) the location of the symbol position 212' associated with the special magnetic symbol 221' within the primary array 210*a*, and (3) the orientation of the primary array 210*a* and the feeder arrays 210*b* and 210*c*, the special magnetic symbol 221' attracts the feeder symbols 220' such that the feeder symbols 220' are associated with at least a portion of the first tier of symbol positions 212'*a-h*.

As shown in FIG. 13C, in some implementations of such a concept including the special magnetic symbol 221', each of the mask feeder symbols 220'*m*1-4 is associated with a respective one of the first tier of symbol positions 212'*a-h*. In the case that one or more of the first tier of symbol positions 212'*a-h* is previously associated with a mask symbol 220*m* of the plurality of symbols 220 (e.g., symbol positions 212'*b* and 212'*h*), the mask feeder symbols 220'*m*1-4 are visually transferred to and associated with other ones of the first tier of symbol positions 212'*a-h* (e.g., symbol positions 212'*a* and 212'*c-g*) and then with ones of the second tier of symbol positions 212"*a-f* not previously associated with a mask symbol 220*m*. Such a method of visually transferring the feeder symbols 220' maximizes the benefit of the transferred feeder symbols 220' when evaluating the second primary outcome. Alternatively, the transferred feeder symbols 220' can be visually transferred to and associated with any of the symbol positions 212 of the primary array 210*a*.

Figure 14:
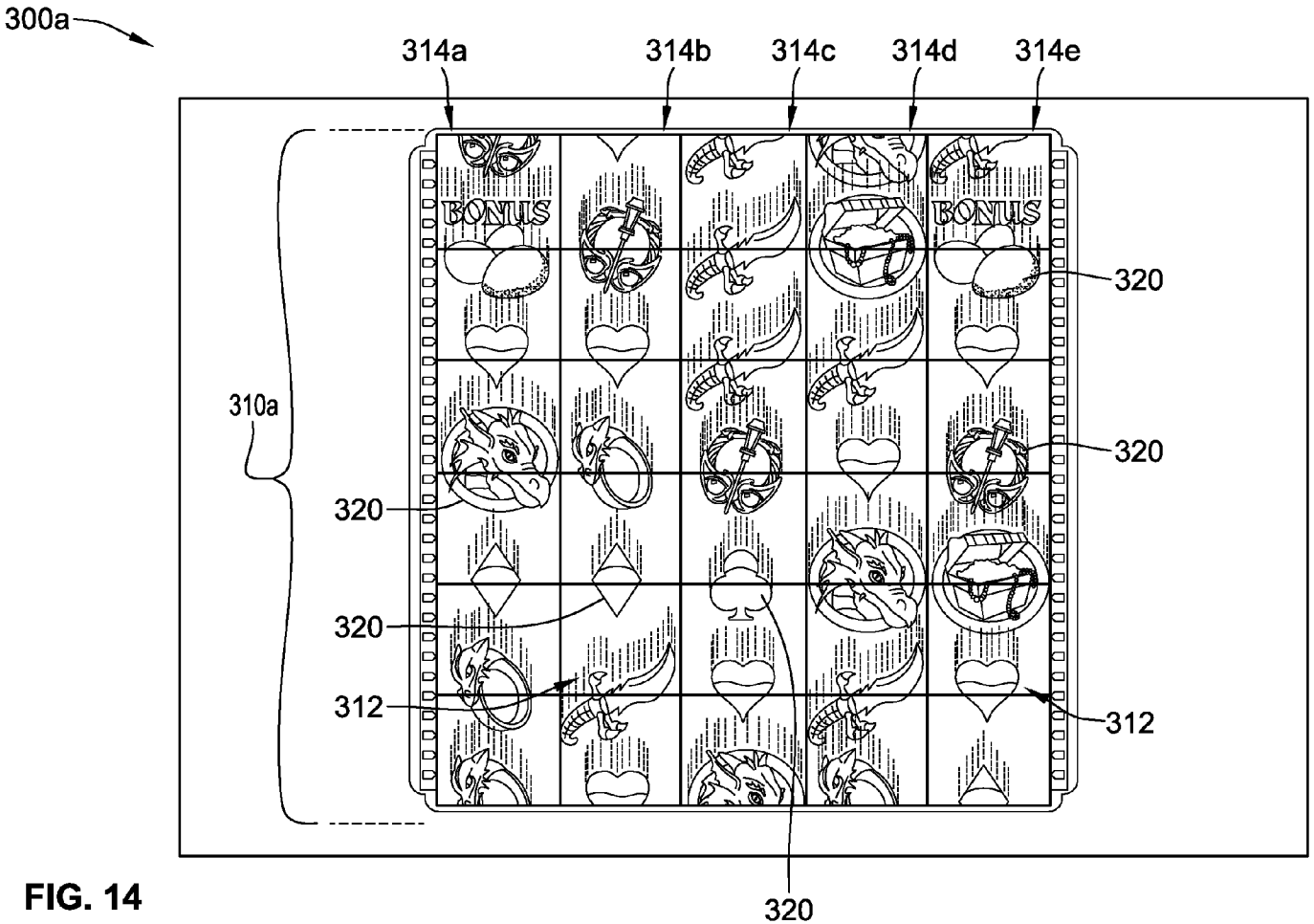
FIGS. 14-16D are screenshots of a display of the free-standing gaming terminal of FIG. 1 including a primary array according to other aspects of the present disclosure.
Figure 15A:
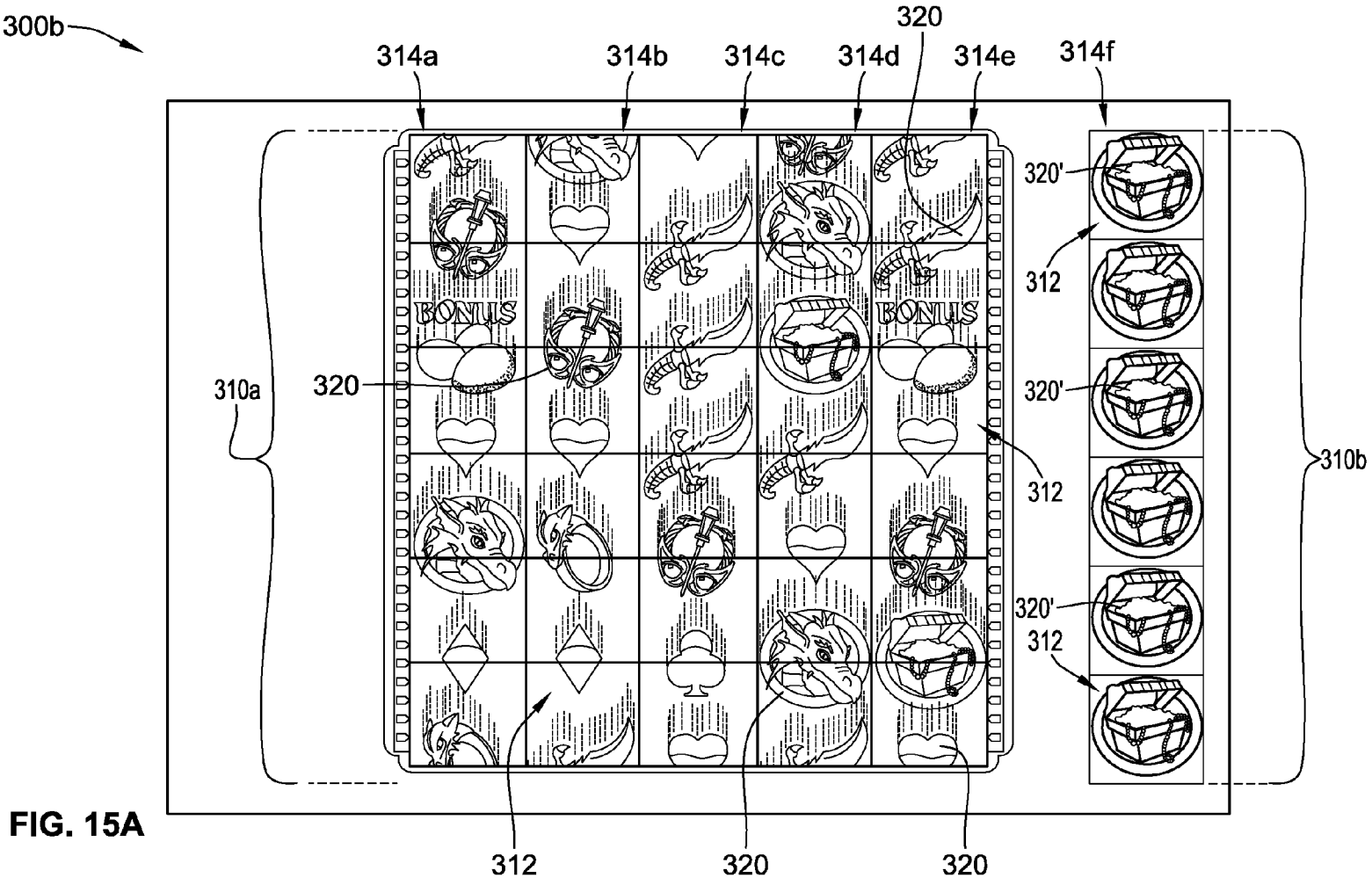
Figure 15B:
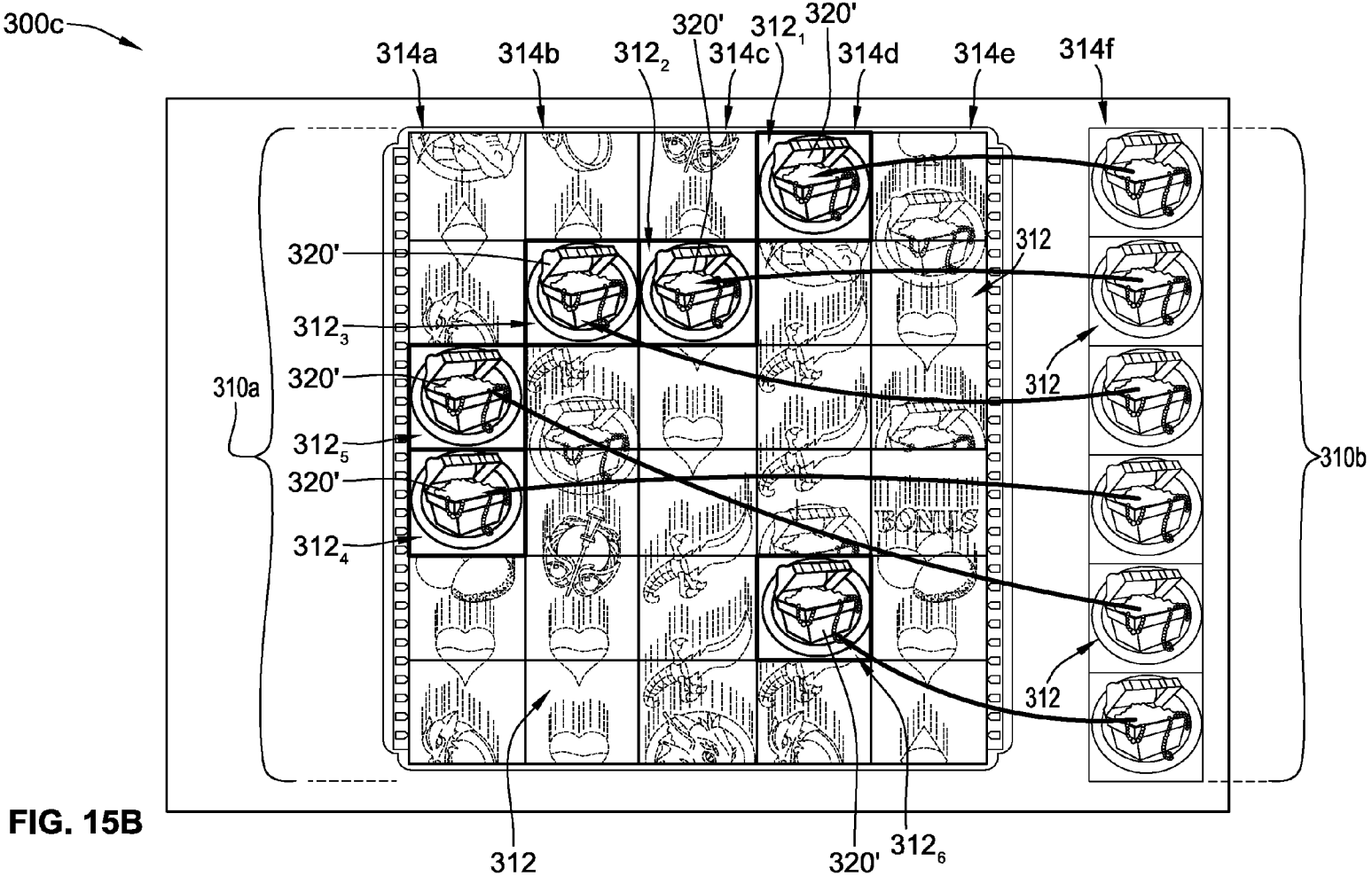
Figure 15C:
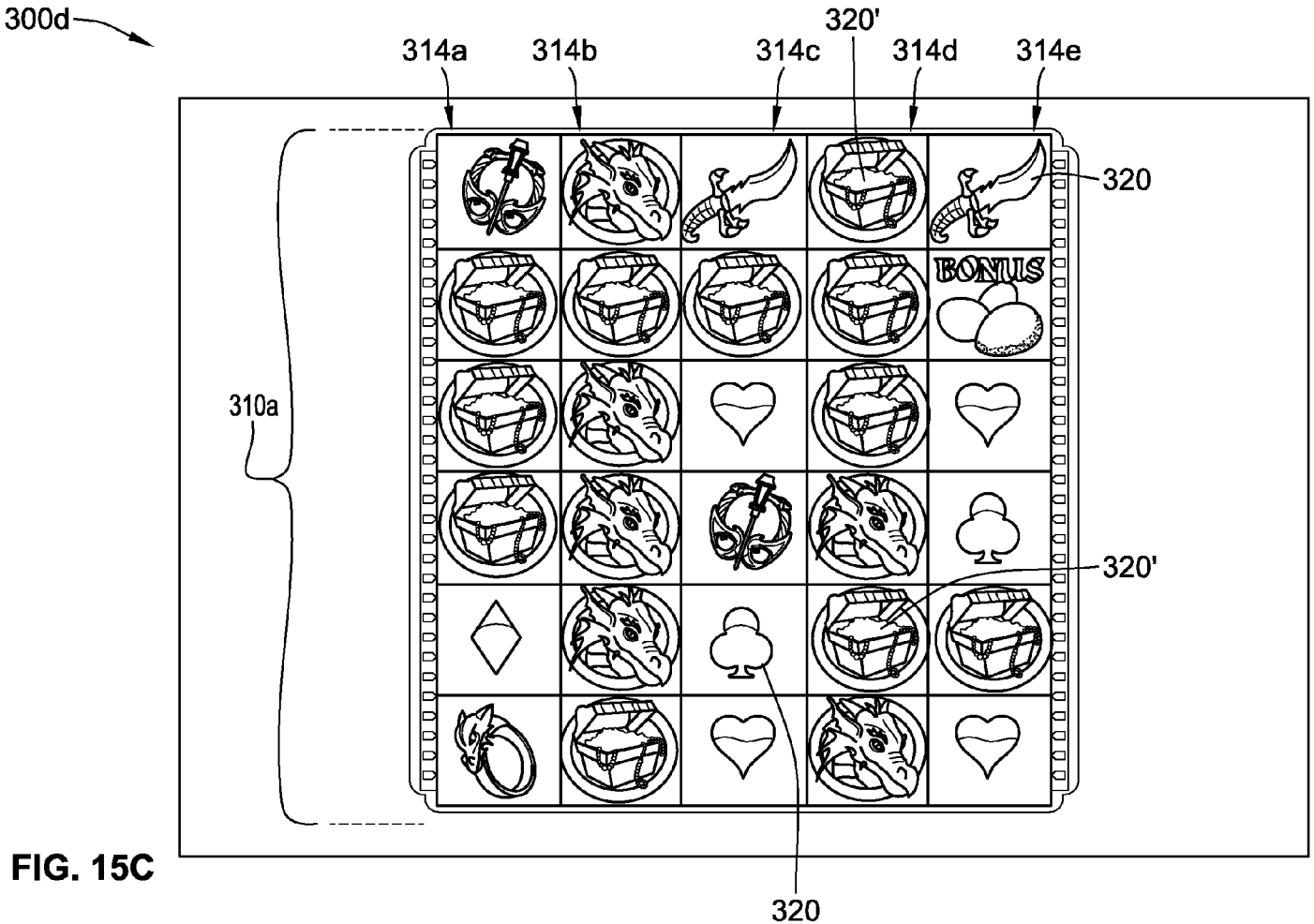

Referring generally to FIGS. 14-15C, screenshots 300*a*-300*d* of the primary display area 12 and/or the secondary display area 14 illustrate one play of a wagering game according to some aspects of the disclosed concepts. Referring specifically to FIG. 14, the screenshot 300*a* includes a primary array of symbol positions 310*a* used in conducting the wagering game, which is the same as, or similar to, the primary array 110*a* described above. In response to the occurrence of a triggering event (e.g., mystery trigger, spinning symbol trigger, time trigger, coin-in trigger, etc.), a feeder array of symbol positions 310*b* appears and/or is displayed (as shown in the screenshot 300*b* of FIG. 15A), which is the same as, or similar to, the feeder arrays 110*b* and 110*c* described above.

The primary array 310*a* is a 6×5 matrix of symbol positions 312 arranged in five columns 314*a-e* and six rows (i.e., thirty symbol positions 312). The primary array 310*a* is formed by a plurality of symbol-bearing reels such that each of the columns 314*a-e* is occupied by a single one of the reels and each of the reels bears at least a portion of a plurality of symbols 320. While the primary array 310*a* is shown as including five columns 314*a-e* and six symbol positions 312 per column, any number of columns and rows can be provided. For example, the primary array can include 2, 3, 4, 5, 6, 7, 10, 20, n, etc. columns with 1, 2, 3, 5, 10, m, etc. rows.

The feeder array 310*b* is a 6×1 matrix of symbol positions 312 arranged in a single column 314*f* and six rows (i.e., six symbol positions 312). Like the primary array 310*a*, the feeder array 310*b* is formed by a symbol-bearing reel such that the column 314*f* is occupied by the single reel bearing at least a portion of a plurality of feeder symbols 320'. The plurality of feeder symbols 320' can include all of, or a portion of, the same symbols in the plurality of symbols 320. While the feeder array 310*b* is shown as including a single column 314*f* with six symbol positions 312, any number of feeder arrays with any number of columns and rows can be provided. For example, the feeder array(s) can include 2, 3, 4, 5, 6, 7, 10, 20, n, etc. columns with 1, 2, 3, 5, 10, m, etc. rows.

The feeder array 310*b* is activated by the occurrence of a triggering event, which makes the feeder array 310*b* a part of the play of the wagering game. Thus, if the triggering event does not occur (not shown), the feeder array 310*b* remains hidden from the player and play of the wagering game continues without the feeder array 310*b*. However, once activated and displayed, the feeder array 310*b* spins and stops to indicate a feeder outcome of feeder symbols 320', as shown in FIG. 15A. Alternatively, the feeder array 310*b* does not spin and stop, but rather initially is displayed indicating the feeder outcome of feeder symbols 320'.

The feeder symbols 320' are visually transferred (e.g., by one or more processors of the gaming terminal 10) from the feeder array 310*b* into the primary array 310*a* in the same, or similar, fashions as described herein in regards to the primary array 110*a* and the feeder arrays 110*b* and 110*c*. The visually transferring of the feeder symbols 320' into the primary array 310*a* occurs prior to a primary outcome of the primary array 310*a* being indicated. The visually transferring and association of the feeder symbols 320' prior to displaying the complete primary outcome adds anticipation and excitement for the player of the wagering game as a portion of the primary outcome, based on the transferred feeder symbols 320', is shown.

As shown in the screenshot 300*c* of FIG. 15B, all of the feeder symbols 320' associated with the feeder array 310*b* are visually transferred into the primary array 310*a*. Specifically, each of the feeder symbols 320' is visually transferred and associated with a random one of the symbol positions 312 of the primary array 310*a*. The random association of the feeder symbols 320' with the respective symbol positions 312 of the primary array 310*a* blocks any of the symbols 320 of the spinning reels in the columns 314*a-e* from becoming associated with those respective symbol positions 312. For example, as shown in FIG. 15B, the feeder symbols 320' are shown as having been randomly associated with symbol positions $\mathbf{312}_{1\text{-}6}$ of the primary array 310*a*. Thus, each of the symbol positions $\mathbf{312}_{1\text{-}6}$ is blocked from becoming associated with one of the symbols 320 for the primary outcome of the current play of the wagering game.

Subsequent to all of the feeder symbols 320' being visually transferred into the primary array 310*a*, the spinning reels in the columns 314*a-e* of the primary array 310*a* stop spinning such that one of the symbols 320 is associated with each of the symbol positions 312 of the primary array 310*a* not already associated with one of the feeder symbols 320', thereby indicating the primary outcome of the current play of the wagering game, which is shown in FIG. 15C.

The primary outcome is evaluated (e.g., by one or more processors of the gaming terminal 10) to determine if it is a winning outcome. If the first primary outcome is a winning outcome, an award is provided to the player of the wagering game, such as, for example, credits based on a value associated with the winning outcome in the pay table.

Figure 16A:
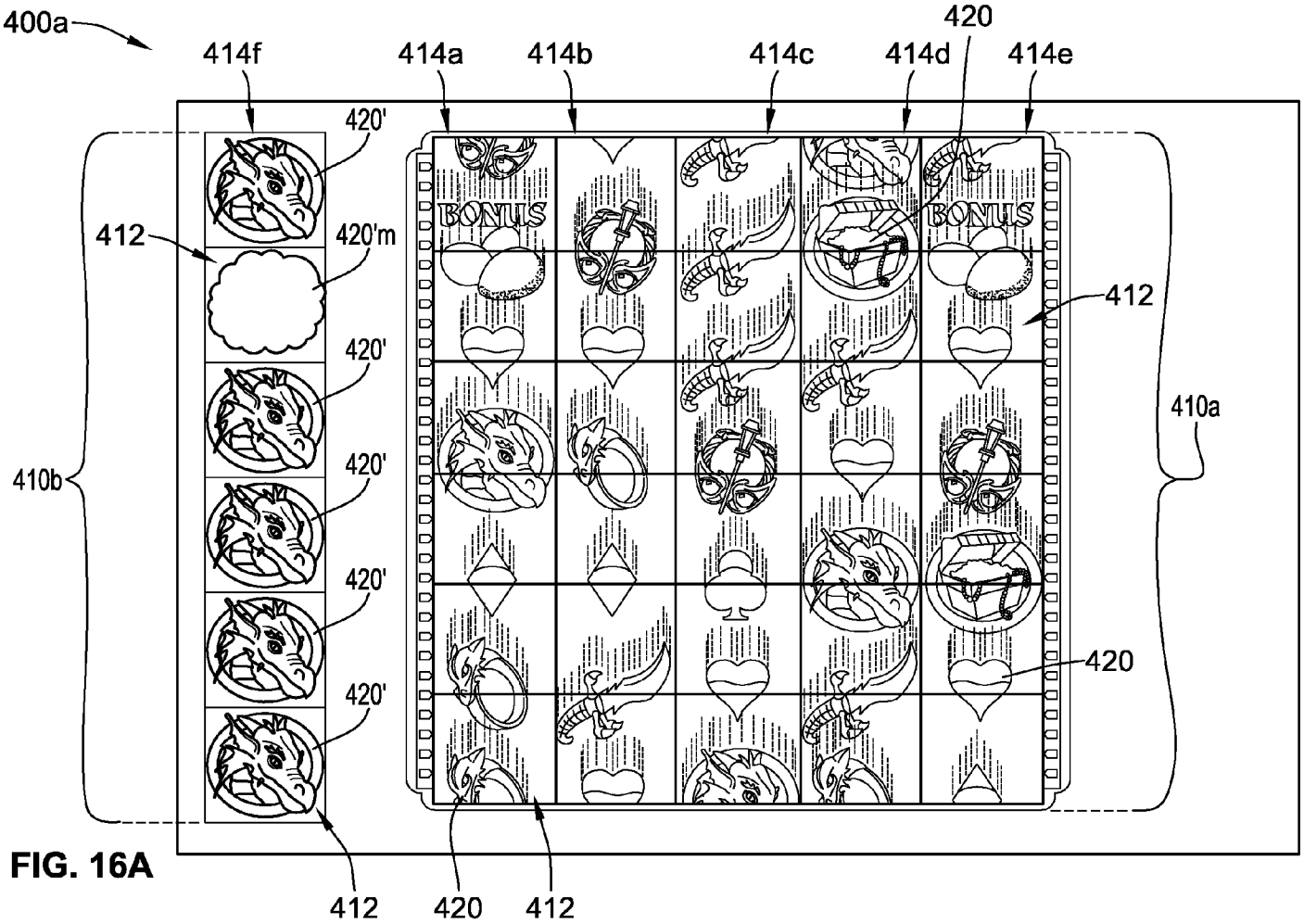

An alternative method of the concepts described above in reference to FIGS. 14-15C includes a feeder array with a symbol position associated with a special magnetic feeder symbol 420'*m* that is similar to, or the same as, the special magnetic symbol 121' described above in reference to FIG. 8. Referring generally to FIGS. 16A-16D, screenshots 400*a*-400*d* of the primary display area 12 and/or the secondary display area 14 illustrate one play of a wagering game according to some aspects of the disclosed concepts. Referring specifically to FIG. 16A, the screenshot 400*a* includes a primary array of symbol positions 410*a* and a feeder array of symbol position 410*b* used in conducting the wagering game, which are the same as, or similar to, the primary array 310*a* and the feeder array 310*b* described above. In the same, or similar, fashion to the feeder array 310*b*, the feeder array 410*b* is activated and appears and/or is displayed in response to the occurrence of a triggering event (e.g., mystery trigger, spinning symbol trigger, time trigger, coin-in trigger, etc.).

The primary array 410*a* is a 6×5 matrix of symbol positions 412 arranged in five columns 414*a-e* and six rows (i.e., thirty symbol positions 412). The primary array 410*a* is formed by a plurality of symbol-bearing reels such that each of the columns 414*a-e* is occupied by a single one of the reels and each of the reels bears at least a portion of a plurality of symbols 420. While the primary array 410*a* is shown as including five columns 414*a-e* and six symbol positions 412 per column, any number of columns and rows can be provided. For example, the primary array can include 2, 3, 4, 5, 6, 7, 10, 20, n, etc. columns with 1, 2, 3, 5, 10, m, etc. rows.

The feeder array 410*b* is a 6×1 matrix of symbol positions 412 arranged in a single column 414*f* and six rows (i.e., six symbol positions 412). Like the primary array 410*a*, the feeder array 410*b* is formed by a symbol-bearing reel such that the column 414*f* is occupied by the single reel bearing at least a portion of a plurality of feeder symbols 420'. The plurality of feeder symbols 420' can include all of, or a portion of, the same symbols in the plurality of symbols 420. Additionally, the feeder symbols 420' can include a special feeder symbol, such as, for example, the special magnetic feeder symbol 420'*m*, which is the same as, or similar to, the special magnetic symbol 121'. While the feeder array 410*b* is shown as including a single column 414*f* with six symbol positions 412, any number of feeder arrays with any number of columns and rows can be provided. For example, the feeder array(s) can include 2, 3, 4, 5, 6, 7, 10, 20, n, etc. columns with 1, 2, 3, 5, 10, m, etc. rows.

The feeder array 410*b* is activated by the occurrence of the triggering event, which makes the feeder array 410*b* a part of the play of the wagering game. Once activated and displayed, the feeder array 410*b* spins and stops to indicate a feeder outcome of feeder symbols 420', as shown in FIG. 16A. Alternatively, the feeder array 410*b* does not spin and stop, but rather is initially displayed indicating the feeder outcome. After the column 414*f* stops spinning, and while at least one of the columns 414*a-e* of the primary array 410*a* spins, the feeder outcome is provided by the feeder symbols 420' associated with the symbol positions 412 in the column 414*f* of the feeder array 410*b*. As shown in FIG. 16A, the feeder outcome includes the special magnetic feeder symbol 420'*m* being associated with one of the symbol position 412 of the feeder array 410*b*.

The feeder symbols 420' are visually transferred (e.g., by one or more processors of the gaming terminal 10) from the feeder array 410*b* into the primary array 410*a* in the same, or similar, fashions as described herein in regards to the primary arrays 110*a* and 310*a* and the feeder arrays 110*b*, 110*c*, and 310*b*. The visually transferring of the feeder symbols 420', including the special magnetic feeder symbol 420'*m*, into the primary array 410*a* occurs prior to a primary outcome of the primary array 410*a* being indicated.

Figure 16B:
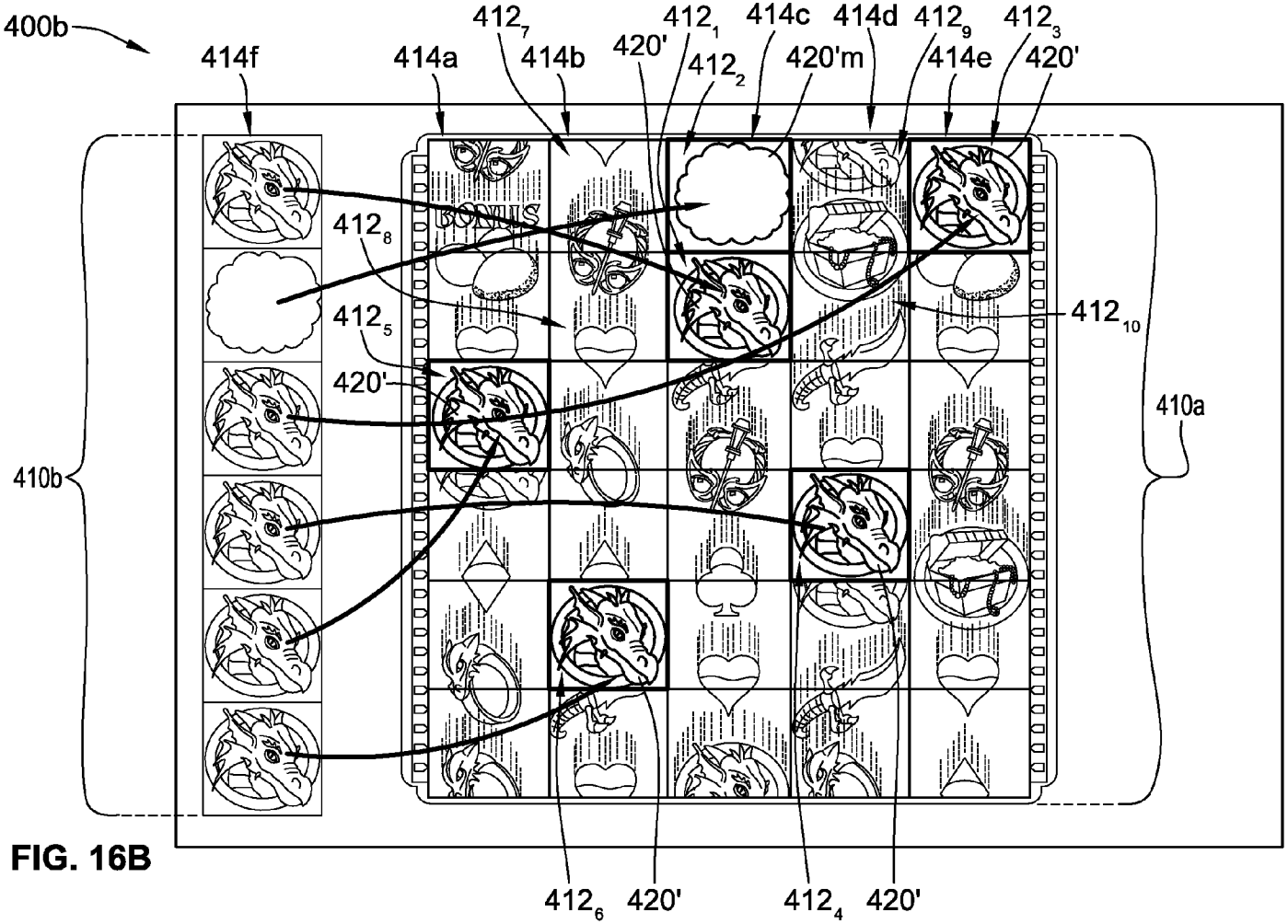

As shown in the screenshot 400*b* of FIG. 16B, all of the feeder symbols 420', including the special magnetic feeder symbol 420'*m*, are visually transferred from the feeder array 410*b* into the primary array 410*a*. Specifically, each of the feeder symbols 420', 420'*m* is visually transferred and associated with a random one of the symbol positions 412 of the primary array 410*a*. For example, as shown in FIG. 16B, the feeder symbols 420' are shown as having been randomly associated with symbol positions $\mathbf{412}_{1\text{-}6}$ of the primary array 410*a*.

Figure 16C:
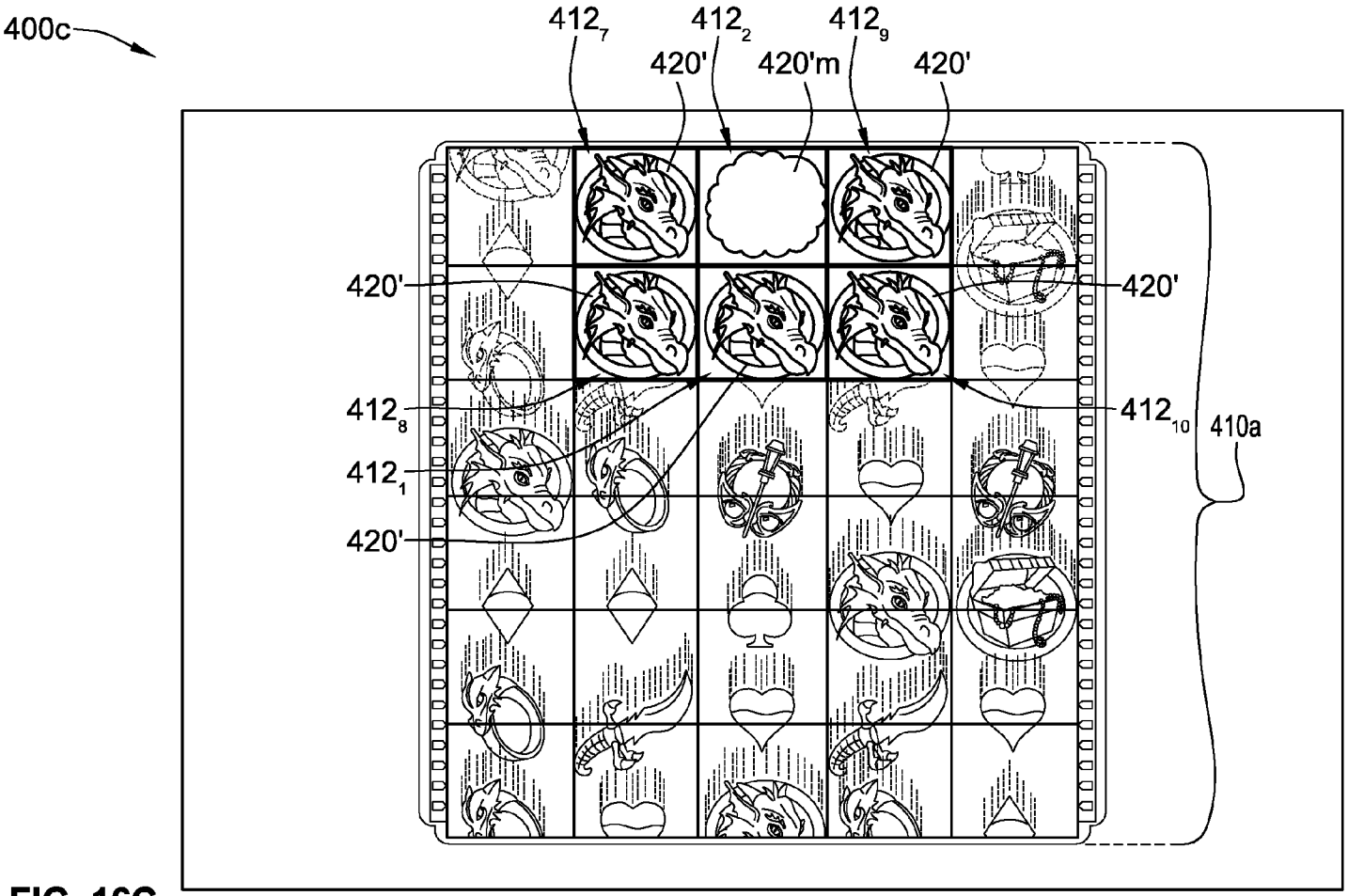

Referring to the screenshot 400*c* of FIG. 16C, subsequent to the feeder symbols 420' being randomly associated with the symbol positions $\mathbf{412}_{1\text{-}6}$, at least a portion of the non-special feeder symbols 420' transferred into the primary array 410*a* is visually re-associated (e.g., by one or more processors of the gaming terminal 10) with different ones of the symbol positions 412. Specifically, the special magnetic feeder symbol 420'*m* visually attracts (e.g., by one or more processors of the gaming terminal 10) the transferred non-special feeder symbols 420' toward its associated symbol position $\mathbf{412}_2$ such that the portion of the non-special feeder symbols 420' is visually re-associated with ones of a first tier of symbol positions 412 (e.g., symbol positions $\mathbf{412}_1$ and $\mathbf{412}_{7\text{-}10}$). The first tier of symbol positions $\mathbf{412}_1$ and $\mathbf{412}_{7\text{-}10}$ includes the symbol positions 412 that surround and are directly adjacent to the symbol position $\mathbf{412}_2$ associated with and/or including the special magnetic feeder symbol 420'*m*.

By portion of the non-special symbols 420' it is meant that ones of the non-special feeder symbols 420' not already associated with one of the first tier of symbol positions $\mathbf{412}_1$ and $\mathbf{412}_{7\text{-}10}$ are visually re-associated with respective ones of the first tier of symbol positions 412$_1$ and 412$_{7-10}$. Thus, the non-special feeder symbol 420' that is initially associated with the first tier symbol position 412$_1$ (FIG. 16B) remains associated with that symbol position 412$_1$ and is not re-associated. Additionally, if necessary, for example, do to the number of non-special feeder symbols 420', the ones of the non-special feeder symbols 420' not already associated with one of the first tier of symbol positions 412$_1$ and 412$_{7-10}$ can be visually transferred to and re-associated with ones of a second tier of symbol positions (e.g., symbol positions that surround and are directly adjacent to the first tier of symbol position 412$_1$ and 412$_{7-10}$). Such a method of visually transferring and re-associating the feeder symbols 420' can maximize the benefit of the transferred feeder symbols 420' when evaluating the primary outcome.

The re-association of the portion of non-special feeder symbols 420' is based on simulated magnetic-like properties of the special magnetic feeder symbol 420'*m* in the same or, similar, fashions as the simulated magnetic properties of the special magnetic symbol 121' described above in reference to FIG. 8. Thus, depending on one or more of (1) the number of non-special feeder symbols 420' transferred into the primary array 410*a* from the feeder array 410*b*, (2) the location of the symbol position 412$_2$ associated with the special magnetic feeder symbol 420'*m* within the primary array 410*a*, and (3) the location of the symbol positions 412$_1$ and 412$_{3-6}$ associated with the visually transferred non-special feeder symbols 420' within the primary array 410*a* prior to the re-association, the special magnetic feeder symbol 420'*m* attracts the non-special feeder symbols 420' such that the non-special feeder symbols 420' are associated with at least a portion of the first tier of symbol positions 412$_1$ and 412$_{7-10}$.

The association and/or re-association of the non-special feeder symbols 420' with the first tier of symbol positions 412$_1$ and 412$_{7-10}$ of the primary array 410*a* blocks any of the symbols 420 of the spinning reels in the columns 414*a-e* from becoming associated with the first tier of symbol positions 412$_1$ and 412$_{7-10}$. For example, as shown in FIG. 16C, the non-special feeder symbols 420' are shown as having been associated with and/or re-associated with symbol positions 412$_1$ and 412$_{7-10}$ of the primary array 410*a*. Thus, each of the symbol positions 412$_1$ and 412$_{7-10}$ is blocked from becoming associated with one of the symbols 420 for the primary outcome of the current play of the wagering game.

Figure 16D:
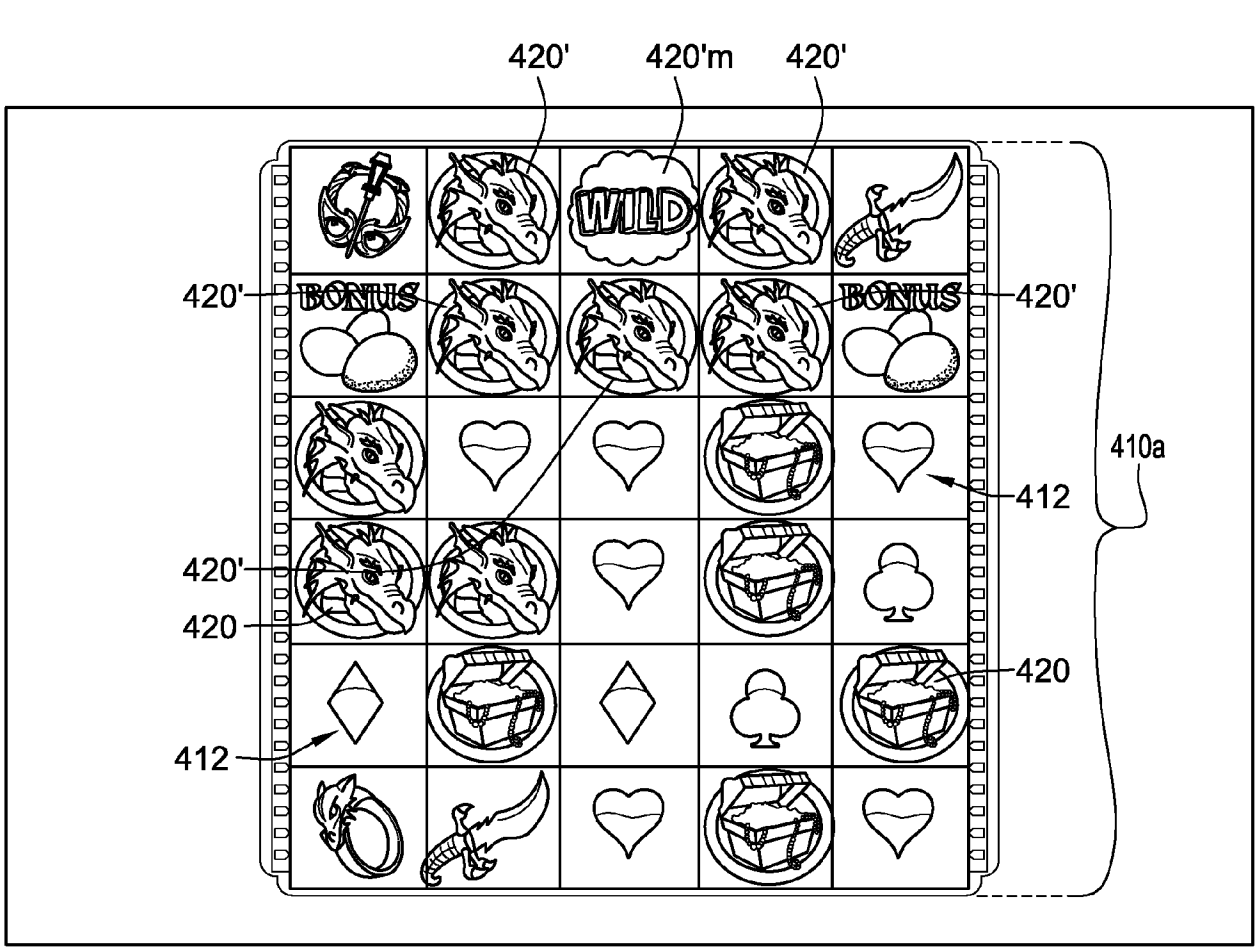

Subsequent to all of the feeder symbols 420' being visually transferred into the primary array 410*a* (FIG. 16B) and visually re-associated (FIG. 16C), the spinning reels in the columns 414*a-e* of the primary array 410*a* stop spinning (FIG. 16D) such that one of the symbols 420 is associated with each of the symbol positions 412 of the primary array 410*a* not already associated with one of the feeder symbols 420', thereby indicating the primary outcome of the current play of the wagering game, which is shown in FIG. 16D.

The primary outcome (FIG. 16D), including the re-associated non-special feeder symbols 420', is evaluated (e.g., by one or more processors of the gaming terminal 10) to determine if it is a winning outcome. If the primary outcome is a winning outcome, an award is provided to the player of the wagering game, such as, for example, credits based on a value associated with the winning outcome in the pay table. The evaluation of the primary outcome of the wagering game shown in FIGS. 16A-16D can include the evaluation of the special magnetic feeder symbol 420'*m* as a wild symbol (shown in FIG. 16D), a high paying symbol, a mystery symbol, or a dedicated trigger symbol (e.g., no value associated on the pay table).

While the plurality of feeder symbols 120', 220', 320', and 420' are described above as including all of, or a portion of, the same symbols in the plurality of symbols 120, 220, 320, and 420, respectively, the plurality of feeder symbols 120', 220', 320', and 420' can include symbols not included in the plurality of symbols 120, 220, 320, and 420, such as, for example, feeder wild symbols, feeder bonus symbols, feeder trigger symbols, etc.

Alternatively to the feeder arrays 310*b* and 410*b* appearing and/or being displayed in response to the occurrence of a triggering event, the feeder arrays 310*b* and 410*b* can be displayed initially at the start of the play of the wagering game along with the primary arrays 310*a* and 410*a* and the visually transferring of the feeder symbols 320' and 420' can be caused by the occurrence of a triggering event.

Throughout the disclosure, reference is made to primary arrays (e.g., primary arrays 110*a*, 210*a*, 310*a*, and 410*a*) and feeder arrays (e.g., feeder arrays 110*b*, 110*c*, 210*b*, 210*c*, 310*b*, and 410*b*). In some implementations of the disclosed concepts, a primary array differs from a feeder array in that a primary array indicates an outcome that is evaluated against a pay table to determine if it is a winning outcome and a feeder array does not indicate an outcome that is evaluated against a pay table (e.g., a feeder outcome is not evaluated). In other implementations of the disclosed concepts, a primary array differs from a feeder array in that each of the symbol-bearing reels of the primary array include a larger number of different symbols than the symbol-bearing reel(s) of the feeder array(s) (e.g., reels of the primary array are associated with more symbols types than reels of the feeder array). In other implementations of the disclosed concepts, a primary array differs from a feeder array in that the primary array is larger (e.g., includes more symbol positions, includes more columns, includes more rows, or a combination thereof) than each the feeder array(s). In further implementations of the disclosed concepts, a primary array differs from a feeder array in that the primary array includes symbol-bearing reels that spin and the feeder array does not include symbol-bearing reels that spin; rather the feeder array includes symbol positions associated with stationary symbol that do not spin (e.g., the feeder array displays symbols that do not spin and are visually stationary until transferred into the primary array). In even further implementations of the disclosed concepts, a primary array differs from a feeder array in that the symbol-bearing reels of the primary array spin and stop prior to the symbol-bearing reel(s) of the feeder array(s) stopping from spinning. Alternatively, a primary array can differ from a feeder array in that the symbol-bearing reel(s) of the feeder array(s) spins and stops prior to the symbol-bearing reels of the primary array stopping from spinning.

Throughout the disclosure, reference is made to feeder symbols transferring into primary arrays of symbol positions. It is contemplated that the transfer of one or more feeder symbols can occur one symbol at a time (e.g., each feeder symbol is transferred by itself) or as one or more groups of feeder symbols (e.g., all of the feeder symbols are transferred into the primary array at the same time, half of the feeder symbols are transferred into the primary array together and then the second half are transferred together, etc.).

Alternatively to each column of each of the primary and feeder arrays described herein and shown in the figures being formed by a symbol-bearing reel, each of the symbol positions of each of the primary and feeder arrays can be formed by its own independent symbol-bearing reel.

Any of the above disclosed concepts can be combined with one or more of the other disclosed concepts to form various alternative implementations of the disclosed concepts. Additionally, each of the above disclosed concepts and obvious variations thereof is contemplated as falling within the spirit and scope of the claimed invention, which is set forth in the following claims.

What is claimed is:

1. A method for conducting a wagering game via a gaming terminal, the method comprising:

receiving, via an input device, a wager to play the wagering game;

displaying, on one or more display devices, a primary array of symbol positions arranged in a plurality of columns and a feeder array of symbol positions arranged in one or more columns;

randomly distributing, by at least one of one or more processors, a plurality of symbols including a special symbol that acts as a magnetic symbol such that:

(i) each of the symbol positions of the primary array is associated with one of the plurality of symbols thereby forming a first outcome, and (ii) each of the symbol positions of the feeder array is associated with one of the plurality of symbols;

in response to one of the symbol positions of the primary array being associated with the special symbol, visually transferring, by at least one of the one or more processors, a first one of the symbols associated with the feeder array to the primary array of symbol positions, the first one of the symbols thereby being a first transferred symbol; and modifying, by at least one of the one or more processors, the first outcome with the first transferred symbol thereby forming a second outcome, the modifying including attracting the first transferred symbol toward the special symbol such that the first transferred symbol is visually transferred to and associated with one of a first tier of symbol positions of the primary array, the first tier of symbol positions including the symbol positions of the primary array that directly surround the symbol position of the special symbol.

2. The method of claim 1, wherein the modifying includes visually replacing a first symbol of the plurality of symbols associated with the one of the first tier of symbol positions of the primary array with the first transferred symbol thereby forming the second outcome.

3. The method of claim 1, wherein the visually transferring includes visually transferring all of the symbols associated with the feeder array, and are thereby transferred symbols, to the primary array.

4. The method of claim 1, wherein the first transferred symbol is visually transferred to and associated with a first one of the symbol positions of the first tier of symbol positions that is closest to the first transferred symbol prior to the first transferred symbol being visually transferred from the feeder array.

5. The method of claim 1, wherein the symbols associated with the symbol positions of the feeder array comprise one or more clumps of the same symbol.

6. The method of claim 1, wherein the symbols associated with the symbol positions of the feeder array are high paying symbols, wild symbols, bonus symbols, mystery symbols, or a combination thereof.

7. The method of claim 1, wherein the plurality of symbols includes five or more different symbols and the symbols associated with the symbol positions of the feeder array includes three or fewer different symbols.

8. The method of claim 1, further comprising evaluating the first outcome to determine if the first outcome is a winning outcome, and in response to the first outcome being a winning outcome, providing a first award.

9. The method of claim 8, further comprising evaluating the second outcome to determine if the second outcome is a winning outcome, and in response to the second outcome being a winning outcome, providing a second award that is larger than the first award.

10. The method of claim 8, in response to one of the symbol positions of the primary array of symbol positions being associated with the special symbol, the evaluating includes evaluating the special symbol as a wild symbol, a high paying symbol, a mystery symbol, or a dedicated trigger symbol.

11. The method of claim 1, wherein the feeder array is only displayed in response to receiving, via the input device, a second wager.

12. The method of claim 11, further comprising in response to receiving a third wager, displaying, on the one or more display devices, a second feeder array of symbol positions arranged in one or more columns, and wherein the randomly distributing the plurality of symbols includes randomly distributing the plurality of symbols such that each of the symbol positions of the second feeder array is associated with one of the plurality of symbols.

13. The method of claim 12, wherein the primary array, the feeder array, and the second feeder array each includes the same number of symbol positions.

14. The method of claim 1, further comprising, prior to the visually transferring, in response to the one of the symbol positions of the primary array being associated with the special symbol, randomly selecting, by at least one of the one or more processors, one of the plurality of symbols to be visually transferred from the feeder array to the primary array.

15. The method of claim 14, further comprising evaluating the second outcome to determine if the second outcome is a winning outcome, and in response to the second outcome being a winning outcome, providing an award, the evaluating including evaluating the special symbol as the randomly selected symbol.

16. The method for conducting a wagering game via a gaming terminal, the method comprising:

receiving, via an input device, a wager to play the wagering game;

displaying, on one or more display devices, a primary array of symbol positions arranged in a plurality of columns and a feeder array of symbol positions arranged in one or more columns;

randomly distributing, by at least one of one or more processors, a plurality of symbols including a special symbol that acts as a magnetic symbol such that:

(i) each of the symbol positions of the primary array is associated with one of the plurality of symbols thereby forming a first outcome, and (ii) each of the symbol positions of the feeder array is associated with one of the plurality of symbols;

in response to one of the symbol positions of the primary array being associated with the special symbol, visually transferring, by at least one of the one or more processors, all of the symbols associated with the feeder array, and are thereby transferred symbols, to the primary array of symbol positions; and modifying, by at least one of the one or more processors, the first outcome with the transferred symbols thereby forming a second outcome, the modifying including attracting the transferred symbols towards the special symbol such that each of one or more of the symbol positions directly adjacent to the symbol position of the special symbol is associated with one of the transferred symbols thereby forming the second outcome.

17. A method for conducting a wagering game via a gaming terminal, the method comprising:

receiving, via an input device, a wager to play the wagering game;

displaying, on one or more display devices, a primary array of symbol positions arranged in a plurality of columns and a feeder array of symbol positions arranged in one or more columns;

randomly distributing, by at least one of one or more processors, a plurality of symbols including a special symbol such that:

(i) each of the symbol positions of the primary array is associated with one of the plurality of symbols thereby forming a first outcome, and (ii) each of the symbol positions of the feeder array is associated with one of the plurality of symbols;

in response to one of the symbol positions of the primary array being associated with the special symbol, visually transferring, by at least one of the one or more processors, all of the symbols associated with the feeder array, and are thereby transferred symbols, to the primary array of symbol positions; and modifying, by at least one of the one or more processors, the first outcome with the transferred symbols thereby forming a second outcome, wherein symbol positions of the primary array that directly surround the symbol position associated with the special symbol are first tier symbol positions and wherein symbol positions of the primary array that directly surround the first tier symbol positions are second tier symbol positions, the modifying further including (a) visually replacing at least a portion of the symbols associated with the first tier symbol positions with the transferred symbols and (b) visually replacing at least a portion of the symbols associated with the second tier symbol positions with the transferred symbols thereby forming the second outcome.

18. A method for conducting a wagering game via a gaming terminal, the method comprising:

receiving, via an input device, a wager to play the wagering game;

displaying, on one or more display devices, a primary array of symbol positions arranged in a plurality of columns and a feeder array of symbol positions arranged in one or more columns;

randomly distributing, by at least one of one or more processors, a plurality of symbols including a special symbol that acts as magnet symbol such that:

(i) each of the symbol positions of the primary array is associated with one of the plurality of symbols thereby forming a first outcome, and (ii) each of the symbol positions of the feeder array is associated with one of the plurality of symbols;

in response to one of the symbol positions of the primary array being associated with the special symbol, randomly selecting, by at least one of the one or more processors, one of the plurality of symbols to be visually transferred;

visually transferring, by at least one of the one or more processors, the randomly selected symbol from each of the symbol positions of the feeder array associated with the randomly selected symbol, and are thereby transferred-selected symbols, to the primary array of symbol positions; and modifying, by at least one of the one or more processors, the first outcome with the transferred-selected symbols thereby forming a second outcome, the modifying including attracting the transferred-selected symbols toward the special symbol such that the transferred-selected symbols are visually transferred to and associated with respective ones of a first tier of symbol positions of the primary array, the first tier of symbol positions including the symbol positions of the primary array that directly surround the symbol position of the special symbol.

19. The method of claim 18, further comprising evaluating the second outcome to determine if the second outcome is a winning outcome, and in response to the second outcome being a winning outcome, providing an award, the evaluating including evaluating the special symbol as the randomly selected symbol.

20. A method for conducting a wagering game via a gaming terminal, the method comprising:

receiving, via an input device, a wager to play the wagering game;

displaying, on one or more display devices, a primary array of symbol positions arranged in a plurality of columns, the primary array being formed by a plurality of symbol-bearing reels, each of the columns being occupied by a single one of the reels;

visually spinning, by at least one of one or more processors, the plurality of symbol-bearing reels;

displaying, on the one or more display devices, a feeder array of symbol positions arranged in one or more columns, each of the symbol positions of the feeder array being associated with one of a plurality of feeder symbols including non-special feeder symbols and a special feeder symbol that acts as a magnetic symbol, one of the symbol positions of the feeder array being associated with the special feeder symbol;

randomly selecting, by at least one of the one or more processors, symbol positions of the primary array to be associated with transferred feeder symbols;

visually transferring, by at least one of the one or more processors, all of the feeder symbols from the feeder array to the primary array of symbol positions such that each of the transferred feeder symbols is associated with a respective one of the randomly selected symbol positions of the primary array for evaluation of a random outcome of the wagering game;

stopping, by at least one of the one or more processors, the reels from visually spinning; and visually attracting, by at least one of the one or more processors, the transferred non-special feeder symbols towards the transferred special feeder symbol such that each of at least a portion of the symbol positions that directly surround the symbol position associated with the transferred special feeder symbol is re-associated with one of the transferred non-special feeder symbols, the random outcome being indicated by both the symbol-bearing reels and the transferred feeder symbols.

21. The method of claim 20, wherein the visually transferring is in response to the occurrence of a triggering event.

22. The method for conducting a wagering game via a gaming terminal, the method comprising:

receiving, via an input device, a wager to play the wagering game;

displaying, on one or more display devices, a primary array of symbol positions arranged in a plurality of columns, the primary array being formed by a plurality of symbol-bearing reels, each of the columns being occupied by a single one of the reels;

visually spinning, by at least one of one or more processors, the plurality of symbol-bearing reels;

displaying, on the one or more display devices, a feeder array of symbol positions arranged in one or more columns, each of the symbol positions of the feeder array being associated with one of a plurality of feeder symbols including non-special feeder symbols and a special feeder symbol, one of the symbol positions of the feeder array being associated with the special feeder symbol;

randomly selecting, by at least one of the one or more processors, symbol positions of the primary array to be associated with transferred feeder symbols;

visually transferring, by at least one of the one or more processors, all of the feeder symbols from the feeder array to the primary array of symbol positions such that each of the transferred feeder symbols is associated with a respective one of the randomly selected symbol positions of the primary array for evaluation of a random outcome of the wagering game;

during the visually spinning, in response to all of the feeder symbols being visually transferred to the primary array, visually rearranging, by at least one of the one or more processors, the non-special feeder symbols within the primary array by re-associating each of the non-special feeder symbols with a respective one of a first tier of symbol positions of the primary array, the first tier of symbol positions including the symbol positions of the primary array that directly surround the symbol position associated with the special feeder symbol; and stopping, by at least one of the one or more processors, the reels from visually spinning such that the random outcome is indicated by both the symbol-bearing reels and the transferred feeder symbols.

23. The method of claim 22, further comprising evaluating the random outcome to determine if the random outcome is a winning outcome, and in response to the random outcome being a winning outcome, providing an award, the random outcome being indicated by the symbol-bearing reels, the re-associated non-special feeder symbols, and the special feeder symbol.

24. The method of claim 23, wherein the evaluating includes evaluating the special feeder symbol as a wild symbol, a high paying symbol, a mystery symbol, or a dedicated trigger symbol.

25. A method for conducting a wagering game via a gaming terminal, the method comprising:

receiving, via an input device, a wager to play the wagering game;

displaying, on one or more display devices, a primary array of symbol positions and a feeder array of symbol positions;

randomly populating, by at least one of one or more processors, the symbol positions of the primary array with respective primary symbols and the symbol positions of the feeder array with respective feeder symbols;

in response to one of the symbol positions of the primary array being populated with a special primary symbol that acts as a magnetic symbol, visually transferring, by at least one of the one or more processors, at least one of the feeder symbols to the primary array;

attracting the at least one transferred feeder symbol towards the special primary symbol such that each of one or more of the symbol positions directly adjacent to the symbol position of the special primary symbol is associated with one of the at least one transferred feeder symbol; and evaluating, by at least one of the one or more processors, the primary array with the at least one transferred feeder symbol for any winning outcomes.

26. The method of claim 25, wherein the visually transferring includes visually transferring all of the feeder symbols to the primary array.

27. The method of claim 26, wherein symbol positions of the primary array that directly surround the symbol position associated with the special primary symbol are first tier symbol positions and wherein the symbol positions of the primary array that directly surround the first tier symbol positions are second tier symbol positions, prior to the evaluating, the method further comprising (a) visually replacing at least a portion of the primary symbols associated with the first tier symbol positions with the transferred feeder symbols and (b) visually replacing at least a portion of the primary symbols associated with the second tier symbol positions with the transferred feeder symbols.

28. The method of claim 25, further comprising, prior to the visually transferring, in response to the one of the symbol positions of the primary array being populated with the special primary symbol, randomly selecting, by at least one of the one or more processors, one of the feeder symbols to be visually transferred from the feeder array to the primary array.

29. The method of claim 28, wherein the evaluating includes evaluating the special primary symbol as the randomly selected feeder symbol.

30. A method for conducting a wagering game via a gaming terminal, the method comprising:

receiving, via an input device, a wager to play the wagering game;

displaying, on one or more display devices, a primary array of symbol positions and a feeder array of symbol positions;

randomly populating, by at least one of one or more processors, the symbol positions of the primary array with respective primary symbols and the symbol positions of the feeder array with respective feeder symbols;

in response to one of the symbol positions of the primary array being populated with a special primary symbol that acts as a magnetic symbol, visually transferring, by at least one of the one or more processors, at least one of the feeder symbols to the primary array;

visually attracting the at least one transferred feeder symbol toward the special primary symbol such that each of the at least one transferred feeder symbol is visually transferred to and associated with one of a first tier of symbol positions of the primary array, the first tier of symbol positions including the symbol positions of the primary array that directly surround the symbol position of the special primary symbol; and evaluating, by at least one of the one or more processors, the primary array with the at least one transferred feeder symbol for any winning outcomes.

31. The method of claim 30, wherein each of the at least one transferred feeder symbol is visually transferred to and associated with one of the symbol positions of the first tier of symbol positions that is closest to the respective transferred feeder symbol prior to the respective transferred feeder symbol being visually transferred from the feeder array.

32. The method of claim 30, further comprising, prior to the visually transferring, in response to the one of the symbol positions of the primary array being populated with the special primary symbol, randomly selecting, by at least one of the one or more processors, one of the feeder symbols to be visually transferred from the feeder array to the primary array.

33. The method of claim 32, wherein the evaluating includes evaluating the special primary symbol as the randomly selected feeder symbol.

* * * * *

UNITED STATES PATENT AND TRADEMARK OFFICE

CERTIFICATE OF CORRECTION

PATENT NO. : 8,888,582 B2
APPLICATION NO. : 13/783543
DATED : November 18, 2014
INVENTOR(S) : Daniel P. Louie and Jamie W. Vann It is certified that error appears in the above-identified patent and that said Letters Patent is hereby corrected as shown below:

In the Claims

In Column 22, Line 40 (Claim 16, Line 1), please delete the word "The" and insert -- A --, therefor.

In Column 24, Line 62 (Claim 22, Line 1), please delete the word "The" and insert -- A --, therefor.

Signed and Sealed this
Fourteenth Day of April, 2015

Michelle K. Lee

Michelle K. Lee
*Director of the United States Patent and Trademark Office*